US005997460A

United States Patent [19]

Young

[11] Patent Number: 5,997,460

[45] Date of Patent: Dec. 7, 1999

[54] INLINE DELIVERY VEHICLE FOR A WEB OFFSET PRINTING PRESS

[76] Inventor: Alan D. Young, 4N 338 Avard Rd., West Chicago, Ill. 60185

[21] Appl. No.: 09/015,722

[22] Filed: Jan. 29, 1998

[51] Int. Cl.[6] ..... B31F 1/00

[52] U.S. Cl. ..... 493/461; 493/465; 493/460; 493/459; 493/352; 493/395; 271/274

[58] Field of Search ..... 493/459, 460, 493/461, 465, 395, 352, 475, 478; 83/346, 436.3, 156; 242/171, 172, 176, 182, 187; 271/274

[56] References Cited

U.S. PATENT DOCUMENTS

| | | |
|---|---|---|
| 3,994,221 | 11/1976 | Littleton . |
| 4,108,304 | 8/1978 | McKnight et al. . |
| 4,221,480 | 9/1980 | Spehrley, Jr. . |
| 4,308,946 | 1/1982 | Ouellette . |
| 4,385,537 | 5/1983 | Wolf . |
| 4,441,390 | 4/1984 | Hehler et al. . |
| 4,776,576 | 10/1988 | Kapoor . |
| 4,919,027 | 4/1990 | Littleton . |
| 5,088,719 | 2/1992 | Kiyota et al. . |
| 5,174,435 | 12/1992 | Dorner et al. . |
| 5,244,081 | 9/1993 | Kajii et al. . |
| 5,280,308 | 1/1994 | Takahashi et al. . |
| 5,496,024 | 3/1996 | Luethi et al. . |

OTHER PUBLICATIONS wpm Rota–Cutter Service and Operations Manual May, 1995, published by Western Printing Machiner Company Schiller Park, IL 60176, USA.

*Primary Examiner*—Peter Vo
*Assistant Examiner*—Matthew Luby
*Attorney, Agent, or Firm*—Meroni & Meroni; Charles F. Meroni, Jr.

[57] ABSTRACT

In combination, an inline delivery vehicle for substantially improving performance of a first stage printing press delivery table, for substantially eliminating paper jamming, and for substantially increasing safety of operations. The first stage printing press delivery table has a plurality of driven rollers for increasing the advancing speed of a paper and an upwardly adjustable bracket structure extending above the plurality of driven rollers. The inline delivery vehicle comprises: a first vehicle side positioned perpendicular and proximate the plurality of driven rollers and a second vehicle side positioned perpendicular and proximate the plurality of driven rollers and adjacent the first vehicle side. The first vehicle side and the second vehicle side are removably connected to the upwardly adjustable bracket structure. A plurality of adjustable longitudinally spaced rollers are rotatably connected to and positioned between the first vehicle side and the second vehicle side and the plurality of adjustable longitudinally spaced rollers each have an axis parallel to one another and are positioned parallel and proximate the plurality of driven rollers. A belt tension roller assembly is pivotably connected to and positioned between the first vehicle side and the second vehicle side, the belt tension roller assembly has a tension roller axis being extended parallel and distal the axis of each of the plurality of adjustable longitudinally spaced rollers and a belt is removably coupled to the plurality of adjustable longitudinally spaced rollers and the belt tension roller assembly for rotation of the belt and delivery of the paper. The belt tension roller assembly and the plurality of adjustable longitudinally spaced rollers provide adjustable tension to the belt and the belt is removably and uniformly driven by the plurality of driven rollers to speedily advance the paper.

19 Claims, 7 Drawing Sheets

INLINE DELIVERY VEHICLE FOR A WEB OFFSET PRINTING PRESS

BACKGROUND OF THE INVENTION

1. Field of the Invention

The present invention relates to delivery devices or vehicles for use in the delivery of paper during the first stage of delivery of a printing press. More specifically, the invention is primarily intended for use on the first stage delivery of paper on a web offset printing press delivery table wherein the invention substantially improves performance of the web offset printing press delivery table and substantially eliminates paper jamming while increasing safety of operations.

2. Description of the Prior Art

In the art of printing press delivery tables, particularly web offset printing press delivery tables, paper is delivered in mass quantities and at very high rates of speed and volume. After the paper has completed the printing phase of the printing process the paper is then transported to the delivery phase where the paper will be cut to a required shape, folded if necessary, separated sheet from succeeding sheet, and stacked and sorted.

Immediately prior to the delivery phase a final stage of a printed material finishing process is completed by cutting the printed paper into the required size and shape. Any necessary folding has taken place at this stage of the printing press process. The first stage of the delivery phase of the printing process then is that stage which follows the final stage of a printed material finishing process. The first stage of the delivery phase is the stage where the cut printed paper is delivered to a conveyor where the cut printed paper can then be sorted or stacked. The second -stage of the delivery process then involves the slow down and conveyance of the cut printed paper to the sorting, stacking, and other stations.

During this first stage of the delivery process a key factor is the efficient transfer of the printed paper from the cutting machine, known as a rotary trimmer, to the conveyor of the second stage. In order to deliver the cut printed paper from the rotary trimmer to the conveyor a plurality of driven rollers, or "speed-up" rollers are used to both pull and accelerate away the cut printed paper. The speed-up rollers rotate at a speed equal to and up to 25% faster than the rotation of the rotary trimmer so that the cut printed paper is accelerated away from the rotary trimmer and so that succeeding sheets of cut printed paper can "cleanly" follow leading sheets by leaving a gap between the successive sheets. When successive sheets "bunch up" after leaving the rotary cutter, then jamming can occur and can significantly decrease the efficiency of the delivery process. In addition, workers trying to prevent or clean up the jammed sheets of paper must place their hands close to the rotating rotary trimmer and can be injured.

Jamming can also occur when the sheets of cut printed paper are not properly and uniformly delivered over the speed-up rollers. Prior art devices have attempted to redress these problems, but have been unsuccessful and have created further problems for the printing press industry. One such device used in the printing press delivery art involves a five wheel device that is placed on top of the speed-up rollers to press the cut printed paper leaving the rotary trimmer onto the speed-up rollers and aid the process of accelerating the paper to the conveyor of the second stage.

However, this five-wheeled device while pressing the paper onto the speed-up rollers does not alleviate the jamming problems, rather it creates jamming problems in the area, called a nip, where the paper enters the five-wheeled device as it rides atop the speed-up rollers. In addition, the individual wheeled rollers wear out and can lose their settings because they ride directly on the high speed speed-up rollers. Settings are typically lost within a period of a week. Changing the wheels involves a timely process that can take as long as thirty minutes to perform and this time represents lost printing time and high cost. The delivery table must be stopped in order for the device to be removed from the entire mounting shaft.

In addition, because the wheel rollers are placed directly on top of the speed-up rollers, gaps between the rollers are created and cause additional paper jamming. Workers trying to change or prevent this jamming are again presented with the danger of injury due to the rotating rotary trimmer when they try to fix the problems and keep the printing press running. Furthermore, the five wheels do not cover all of the speed-up rollers and create more gaps which can lead to further jamming problems. Additionally, by use of a bolt and screw connection this device is designed to direct the angle of delivery of the paper upon leaving the device, however the device utilizes a tail kicker or kicker to "knock down" the trailing edge of a cut printed paper as it leaves the device and enters onto the conveyor of the second stage. The purpose of the kicker is to aid the stacking of the paper and to prevent further jamming. Finally, in order to make any adjustments to this fivewheeled device the user must tighten various bolt and screw connections, a process that requires fine tuning and time.

Other prior art devices created to alleviate these jamming problems involve the use of multiple-belted devices that also run on top of the speed-up rollers. These devices use belts that are around five feet in length and are complicated to fix when there is ajamming problem and workers find it harder to fix a jamming problem with these devices because of the lack of hand room. Furthermore, when a belt(s) breaks and must be changed, the printing press is almost always stopped so that two or more workers can replace the long belts. This again means machine downtime and loss of money and printing time. The longer belts also mean that there is more room for jamming during delivery Additionally, U.S. Pat. No. 5,088,719 discloses a paper delivery mechanism for web offset printing presses. This device involves multiple belts, a braking roller, a slow down pulley, an upper high speed belt, and a low speed belt and a snubber. The device therein disclosed is a complicated arrangement. The conveying device of U.S. Pat. No. 5,496,024 is also used to transport flat printed products lying on a support formed by a driven first belt. This conveying device transports the printed products forward in a conveying channel by means of a second belt disposed above the first and the entrance region of the channel is configured to be adjustable in height in the cadence of the supplied printed products. However, this device does not teach how to change either belt if the belt needs repair and the device does not teach how to control the paper after it leaves the conveying device.

Accordingly, it is a principal object of my invention to provide an inline delivery vehicle that substantially improves performance of a first stage web offset printing press delivery table and that substantially eliminates the problem of paper jamming and thereby substantially increases the safety of operations of the delivery process.

It is a further object of my invention to provide an inline delivery vehicle that uses a belt to provide a continuum and constant uniform surface area for accelerating paper over the speed-up rollers.

It is a further object of my invention to provide an inline delivery vehicle that is less likely to lose its settings and is less likely to halt the delivery process due to maintenance.

It is a still further object of my invention to provide an inline delivery vehicle that allows for the quick, efficient means for changing and repairing the belt.

It is a further object of my invention to provide an inline delivery vehicle that allows for multiple adjustments to account for different size and types of delivered paper and different control designs.

It is a still further object of my invention to provide an inline delivery vehicle that substantially eliminates the need for a separate kicker to knock-down the trailing edge of the paper for stacking purposes.

It is a further object of my invention to provide an inline delivery vehicle that is less complicated to operate, less costly to run and which is adaptable to different delivery requirements and corresponding paper dimensions.

Other objects of my invention, as well as particular features, elements, and advantages thereof, will be elucidated in, or apparent from, the following description and the accompanying drawing figures.

SUMMARY OF THE INVENTION

According to my present invention I have provided in combination, an inline delivery vehicle for substantially improving performance of a first stage web offset printing press delivery table, for substantially eliminating paper jamming and for substantially increasing safety of operations, the first stage web offset printing press delivery table having a plurality of driven rollers for increasing the advancing speed of a paper, the first stage web offset printing press delivery table having an upwardly adjustable bracket structure extending above the plurality of driven rollers and a conveyor belt being located downstream of the plurality of driven rollers, a rotary trimmer being located upstream of the plurality of driven rollers, the inline delivery vehicle comprising: a first vehicle side extending perpendicularly above the plurality of driven rollers, the first vehicle side being located downstream of the rotary trimmer and upstream of the conveyor belt; a second vehicle side extending perpendicularly above the plurality of driven rollers and adjacent the first vehicle side, the second vehicle side being located downstream of the rotary trimmer and upstream of the conveyor belt, the first vehicle side and the second vehicle side being removably connected to the upwardly adjustable bracket structure; a plurality of adjustable longitudinally spaced rollers being rotatably connected to the first vehicle side and the second vehicle side and being positioned between the first vehicle side and the second vehicle side, the plurality of adjustable longitudinally spaced rollers each having an axis parallel to one another and being positioned parallel and proximate the plurality of driven rollers; a belt tension roller assembly comprising a plurality of tension arms and a guidance roller rotatably connected between the plurality of tension arms, the plurality of tension arms being pivotably connected to the first vehicle side and the second vehicle side and being positioned between the first vehicle side and the second vehicle side, the guidance roller having a tension roller axis being extended parallel and distal the axis of each of the plurality of adjustable longitudinally spaced rollers, the belt tension roller assembly being extended above the plurality of adjustable longitudinally spaced rollers; and a belt being removably coupled to the plurality of adjustable longitudinally spaced rollers and the guidance roller for rotation of the belt and delivery of the paper, the belt tension roller assembly and the plurality of adjustable longitudinally spaced rollers providing adjustable tension to the belt, the belt being removably and uniformly driven by the plurality of driven rollers, the plurality of adjustable longitudinally spaced rollers being properly adjusted and creating a first nip located upstream of the belt and a second nip located downstream of the belt, the inline delivery vehicle thereby speedily advancing the paper from the rotary trirmmer to the conveyor belt, the paper entering at the first nip and exiting at the second nip and thereby substantially eliminating jamming of the paper.

According to other features in my invention I have provided an inline delivery vehicle for substantially improving performance of and for substantially eliminating paper jamming on a first stage web offset printing press delivery table, the inline delivery vehicle comprising: a first vehicle side being perpendicular and proximately positionable to a plurality of driven rollers of the first stage web offset printing press delivery table; a second vehicle side being perpendicular and proximately positionable to the plurality of driven rollers and being adjacent the first vehicle side, the first vehicle side and the second vehicle side being removably connectable to an upwardly adjustable bracket structure of the first stage web offset printing press delivery table; a plurality of adjustable longitudinally spaced rollers being rotatably connected to the first vehicle side and the second vehicle side and being positioned between the first vehicle side and the second vehicle side, the plurality of adjustable longitudinally spaced rollers each having an axis parallel to one another and being parallel and proximately positionable to the plurality of driven rollers; a belt tension roller assembly being pivotably connected to the first vehicle side and the second vehicle side and being positioned between the first vehicle side and the second vehicle side, the belt tension roller assembly having a tension roller axis being extended parallel and distal the axis of each of the plurality of adjustable longitudinally spaced rollers, the belt tension roller assembly being extended above the plurality of adjustable longitudinally spaced rollers; and a belt being removably coupled to the plurality of adjustable longitudinally spaced rollers and the belt tension roller assembly for rotation of the belt and delivery of the paper, the belt tension roller assembly and the plurality of adjustable longitudinally spaced rollers providing adjustable tension to the belt, the belt being removably and uniformly driveable by the plurality of driven rollers to speedily advance the paper, the inline delivery vehicle thereby substantially eliminating paper jams.

Yet another feature of my invention relates to a method of delivering a plurality of sheets of paper from a first point to a second point using an inline delivery vehicle operatively connected with a first stage web offset printing press delivery table, each sheet of paper having a thickness, a length, a leading edge and a trailing edge opposite the leading edge, the method comprising the steps of: adjusting a leading nip and a belt of the inline delivery vehicle thereby substantially conforming to the thickness of each paper to substantially eliminate paper jamming; adjusting a trailing nip and the belt of the inline delivery vehicle depending on the length of each sheet of paper; feeding the leading edge of a first sheet of paper through a rotary trimmer at the first point and towards the adjusted leading nip; passing the leading edge of the first fed sheet of paper through the adjusted leading nip and into a pathway between the adjusted belt and driving means; cutting the trailing edge of the first fed sheet of paper while located in the pathway; accelerating the passage of the cut first fed sheet of paper away from the adjusted leading nip and the rotary trimmer so that the trailing edge of the cut first fed sheet of paper passes the adjusted leading nip and into the pathway; feeding the leading edge of a second sheet of paper through the rotary trimmer at the first point and towards the adjusted leading nip; pressing down on the cut first fed sheet of paper while passing through the pathway to provide continuous accelerated nonslip delivery; passing the leading edge of the second fed sheet of paper through the adjusted leading nip and into the pathway between the adjusted belt and driving means; creating a gap between the trailing edge of the cut first fed sheet of paper and the leading edge of the second first fed sheet of paper in the pathway to prevent paper jamming; cutting the trailing edge of the second fed sheet of paper while located in the pathway; passing the leading edge of the accelerated cut first fed sheet of paper through the adjusted trailing nip towards the second point at the conveyor belt while controlling a direction of the accelerated cut first fed sheet of paper at the adjusted trailing nip; accelerating the passage of the cut second fed sheet of paper away from the adjusted leading nip and the rotary trimmer so that the trailing edge of the cut second fed sheet of paper passes the adjusted leading nip and into the pathway; pressing down on the cut second fed sheet of paper while passing through the pathway to provide continuous accelerated nonslip delivery; passing the trailing edge of the accelerated cut first fed sheet of paper through the adjusted trailing nip and towards the second point at the conveyor belt while controlling the direction of the accelerated cut first fed sheet of paper at the trailing nip; passing the leading edge of the accelerated cut second fed sheet of paper through the adjusted trailing nip towards the second point at the conveyor belt while controlling a direction of the accelerated cut second fed sheet of paper at the adjusted trailing nip; and passing the trailing edge of the accelerated cut second fed sheet of paper through the adjusted trailing nip and towards the second point at the conveyor belt while controlling the direction of the accelerated cut second fed sheet of paper at the adjusted trailing nip.

DESCRIPTION OF THE DRAWINGS

Other features of my invention will become more evident from a consideration of the following detailed description of my patent drawings, as follows.

DETAILED DESCRIPTION OF THE PREFERRED EMBODIMENT

Figures 1, 1A:
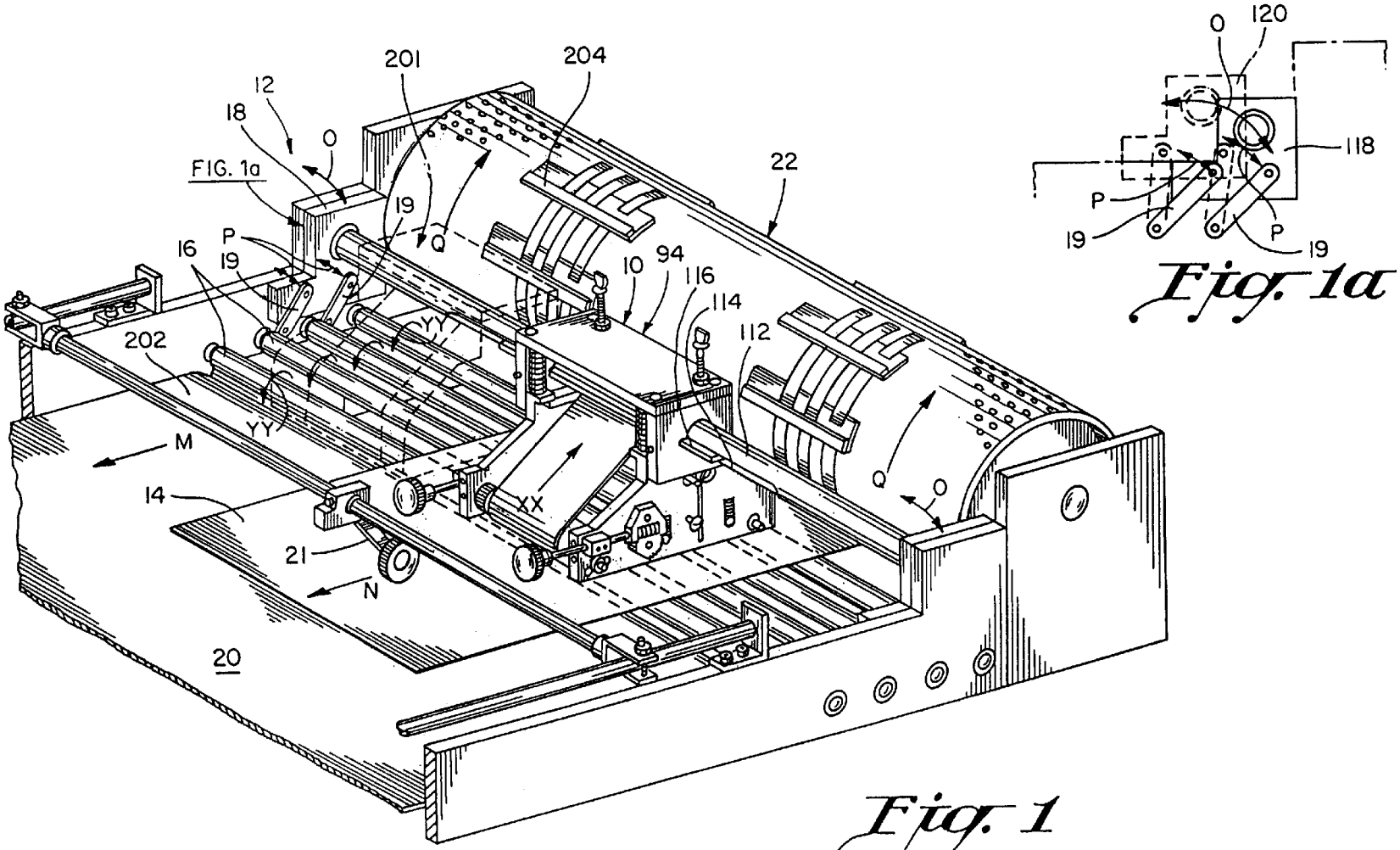
FIG. 1 is perspective view of my new and improved inline delivery vehicle attached to a first stage web offset printing press delivery table and showing a rotary trimmer and a conveyor belt.
FIG. 1*a* is a side schematic cut away view of an upwardly adjustable bracket structure shown in FIG. 1 showing the upward-downward movement of the upwardly adjustable bracket structure.
Figure 2:
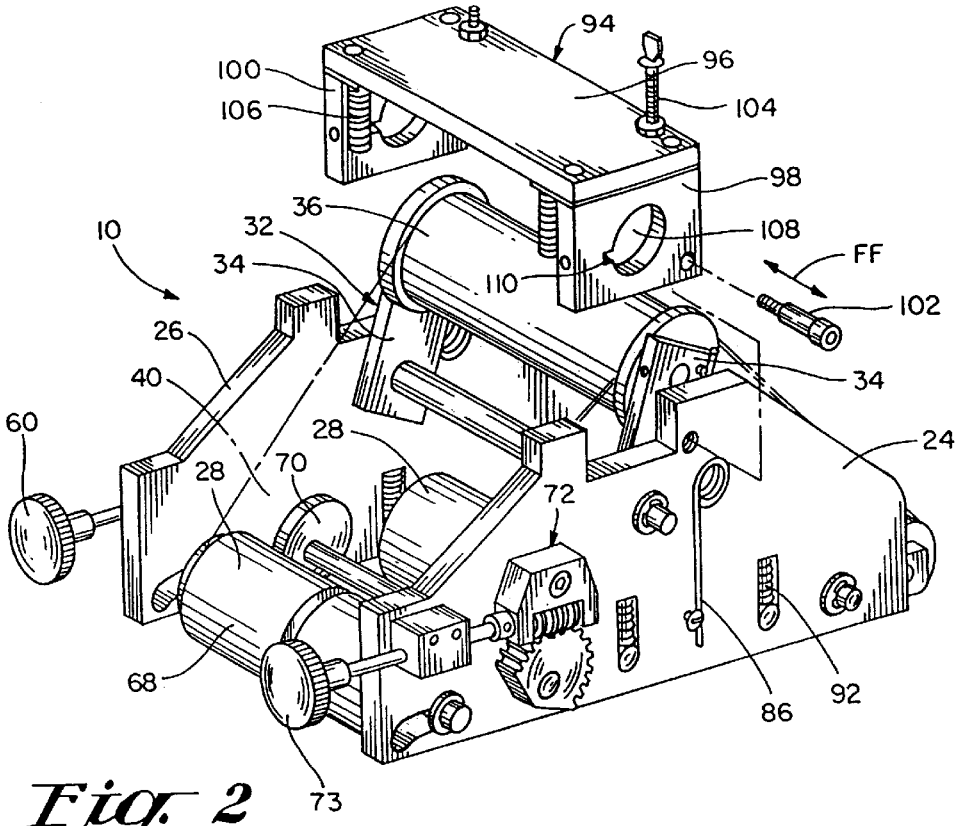
FIG. 2 is an exploded perspective view of the first vehicle side of my new and improved inline delivery vehicle showing the connection of the inline delivery vehicle to the mounting bracket table attachment structure of FIG. 1.

Referring now to the drawings, my invention provides both a new and improved inline delivery vehicle 10 as shown itself in FIG. 2 and the new and improved inline delivery vehicle in combination with a first stage printing press delivery table, in particular, a first stage web offset printing press delivery table 12 as shown in FIG. 1. The purpose of the inline delivery vehicle is to substantially improving performance of the first stage web offset printing press delivery table, to substantially eliminate jamming of a paper 14 and thereby substantially eliminate paper waste, and to substantially increase safety of operations.

Figures 14, 14A:
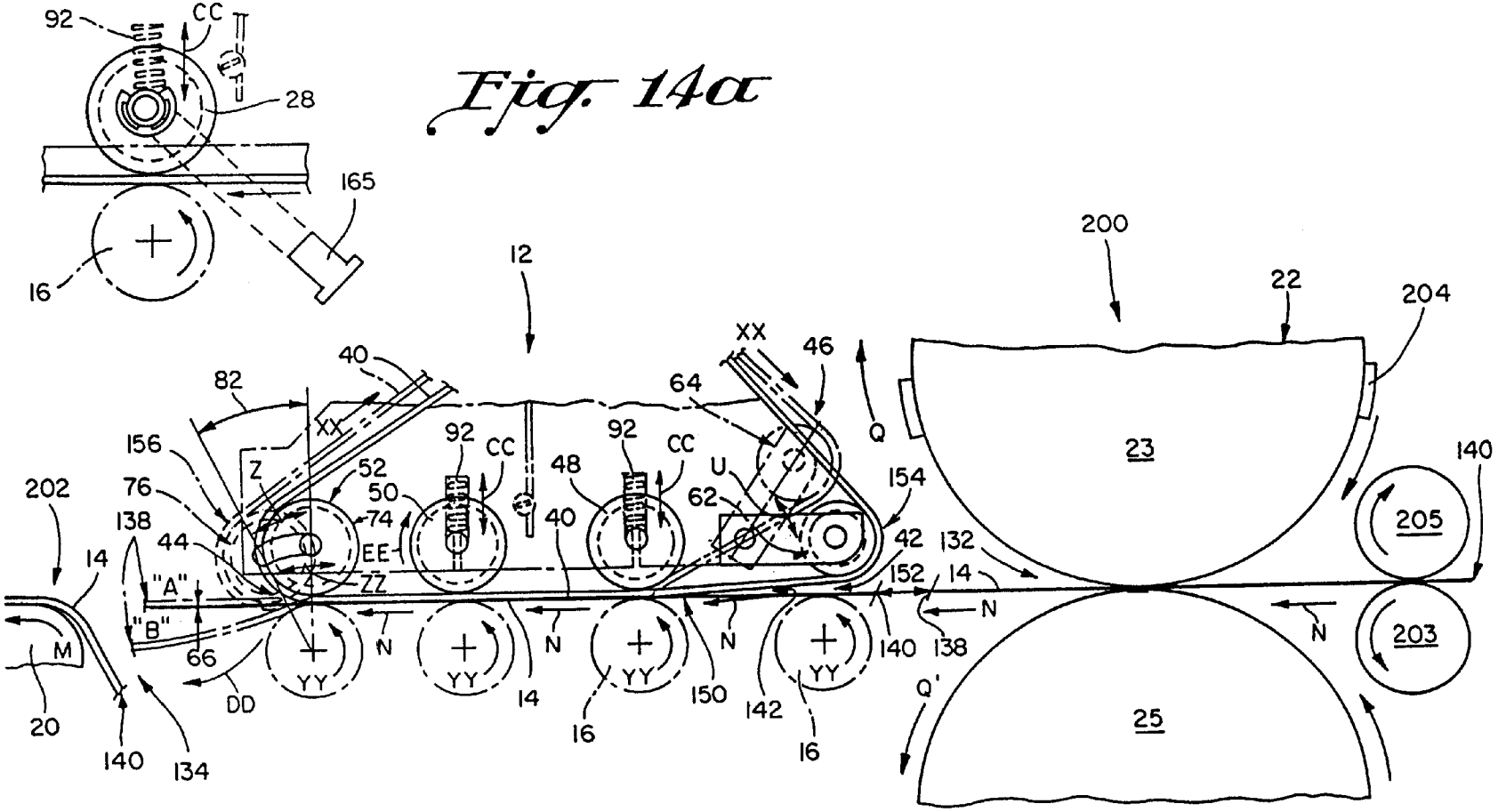
FIG. 14 is a fragmentary side elevational section view of the first vehicle side of the inline delivery vehicle shown in FIGS. 1 and 9, now showing the movement of each sheet of paper from a first point near the rotary trimmer to a second point near the conveyor belt.
FIG. 14*a* is a fragmentary side elevational section view of a second embodiment of a compression spring showing the addition of a bearing sleeve.

The first stage web offset printing press delivery table 12, as shown in FIG. 1 shows the first stage of the printing press' paper delivery phase, the "speed-up" delivery phase. This first stage of the delivery phase immediately follows a cutting phase 200 found at a final stage of a printed materials finishing process shown in FIG. 14. FIGS. 1 and 14 also show the beginning of a second stage of the delivery process 202, the sorting and stacking phase. The first stage web offset printing press delivery table 12, as shown in FIG. 1, has a plurality of driven rollers 16, or "speed-up" rollers as they are known in the art. The plurality of driven rollers, or driving means, are used to increase the advancing speed of the paper 14 and to rapidly move the paper away from the cutting phase, a rotary trimmer 22 which itself comprises a knife cylinder 23 and a anvil cylinder 25, the rotation of which is shown by double-arrows Q and Q' respectively, and the anvil cylinder is operatively connected to the knife cylinder as shown in FIG. 14. The knife cylinder being capable of adjustable knife positioning 204 and as shown in FIG. 1, the knives can be positioned according to the particular job requirements. The inline delivery vehicle 10 is then positioned and lined up with the corresponding knives. In addition, these printing processes can be running at very high speeds, for example, the paper 14 can be moving at rates of 1,500 feet per minute at this stage and the paper is first fed into the cutting phase by at least one drive roller 203 and a corresponding nip roller 205, as shown in FIG. 14. Therefore an adjustable vehicle is needed to prevent paper jamming.

The first stage web offset printing press delivery table also has an upwardly adjustable bracket structure 18 extending above the plurality of driven rollers 16 and a conveyor belt 20 that is located downstream of the plurality of driven rollers. An arrow M shows a direction of rotation of the conveyor belt and an arrow N shows a direction of delivery of the paper. The upwardly adjustable bracket structure is upwardly and downwardly adjustable, as shown by a double-arrow O in both FIGS. 1 and 1*a*, in order to raise the inline delivery vehicle 10 up and off of the plurality of driven rollers 16 for maintenance and repairs, as will be discussed below.

FIGS. 1 and 1*a* also show the means of the upward/downward movement O of the upwardly adjustable bracket structure 18. This means is provided by a plurality of pivot bars 19 that connect the upwardly adjustable bracket structure to the first stage web offset printing press delivery table 12 and provide ultimately, the upward/downward movement of the inline delivery vehicle 10 also shown as O. Upward and downward movement of the plurality of pivot bars is shown by double arrows P in FIGS. 1 and 1*a*. FIG. 1*a* also shows the upwardly adjustable bracket structure being operatively moved from a lowered bracket state 118 to a raised bracket state 120 to effect the upward/downward movement of the inline delivery vehicle for maintenance purposes as described below.

The conveyor belt 20 signifies the beginning of the second stage of the delivery process 202. The second stage, as shown in FIG. 1, also employs a stop wheel 21 used to retard and slow down the paper 14 as it leaves the inline delivery vehicle 10 and the plurality of driven rollers 16 and enters the second stage. The rotary trimmer 22 is then located upstream of the plurality of driven rollers as is shown by an arrow Q showing a direction of rotation of the rotary trimmer so as to move the paper towards the conveyor belt.

Figure 7:
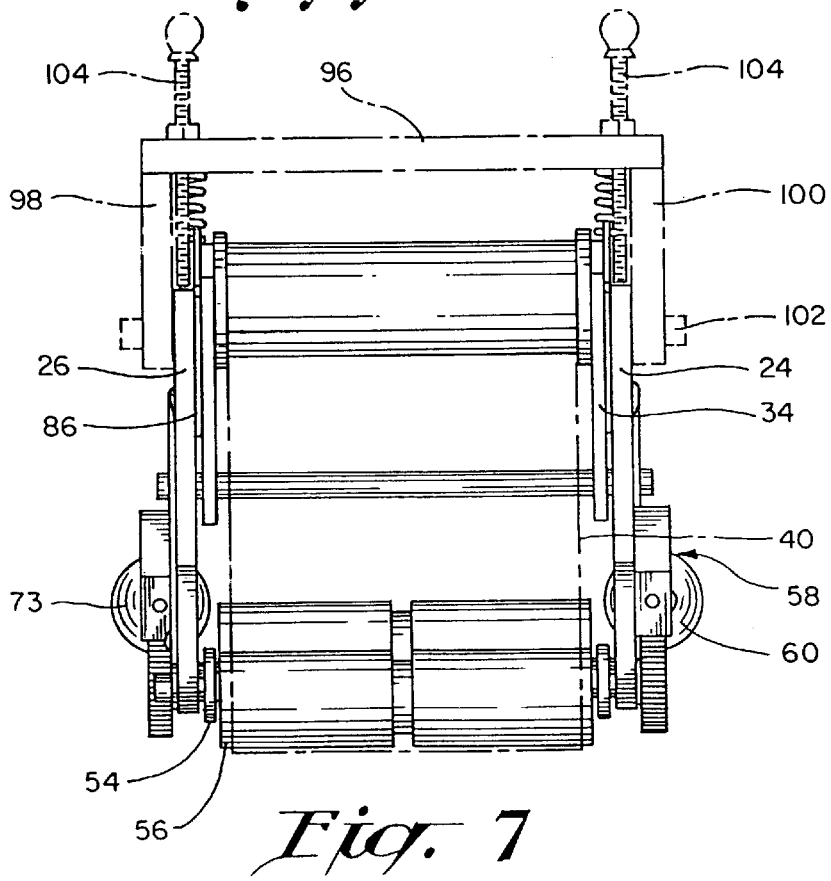
FIG. 7 is a front elevational section view of the inline delivery vehicle of FIG. 6, now showing a first roller, a second roller, and the guidance roller.
Figure 8:
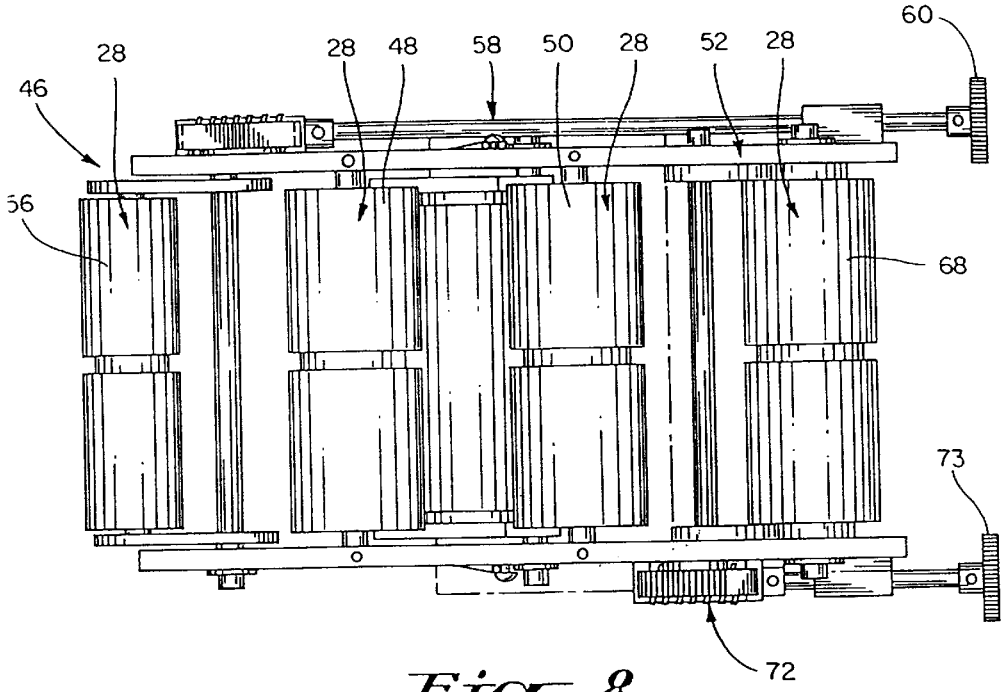
FIG. 8 is a bottom plan view of the inline delivery vehicle of FIG. 6, now showing the plurality of adjustable longitudinally spaced rollers comprising: the first roller, the second roller, a third roller, and the fourth roller.
Figure 9:
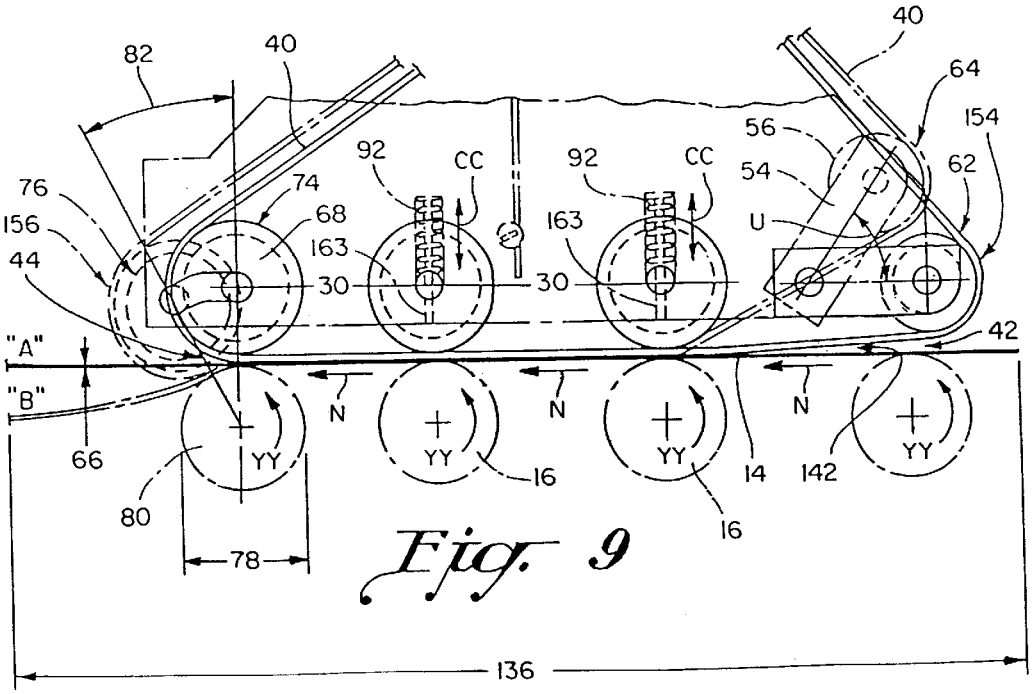
FIG. 9 is a fragmentary side elevational section view of the first vehicle side of the inline delivery vehicle shown in FIG. 1, now showing the adjustment capabilities of plurality of adjustable longitudinally spaced rollers to accomodate the delivery of a paper between the belt and a plurality of driven rollers along either a substantially horizontal pathway, "A", and along a pitched pathway, "B"

The inline delivery vehicle 10, as shown in FIGS. 1, 2–11 inclusive, comprises a first vehicle side 24 extending perpendicularly above the plurality of driven rollers 16, as shown in FIG. 9, and being located downstream of the rotary trimmer 22 and upstream of the conveyor belt 20 as shown with reference to the movement of the paper 14, the arrow N, in FIG. 1. A second vehicle side 26 extends perpendicularly above the plurality of driven rollers and adjacent the first vehicle side, as is shown in FIG. 2, and the second vehicle side is also located downstream of the rotary trimmer and upstream of the conveyor belt. The first vehicle side and the second vehicle side are both removably connected to the upwardly adjustable bracket structure 18, as is shown in FIGS. 1 and 2, and both form the outer structure of the inline delivery vehicle 10.

Figure 3:
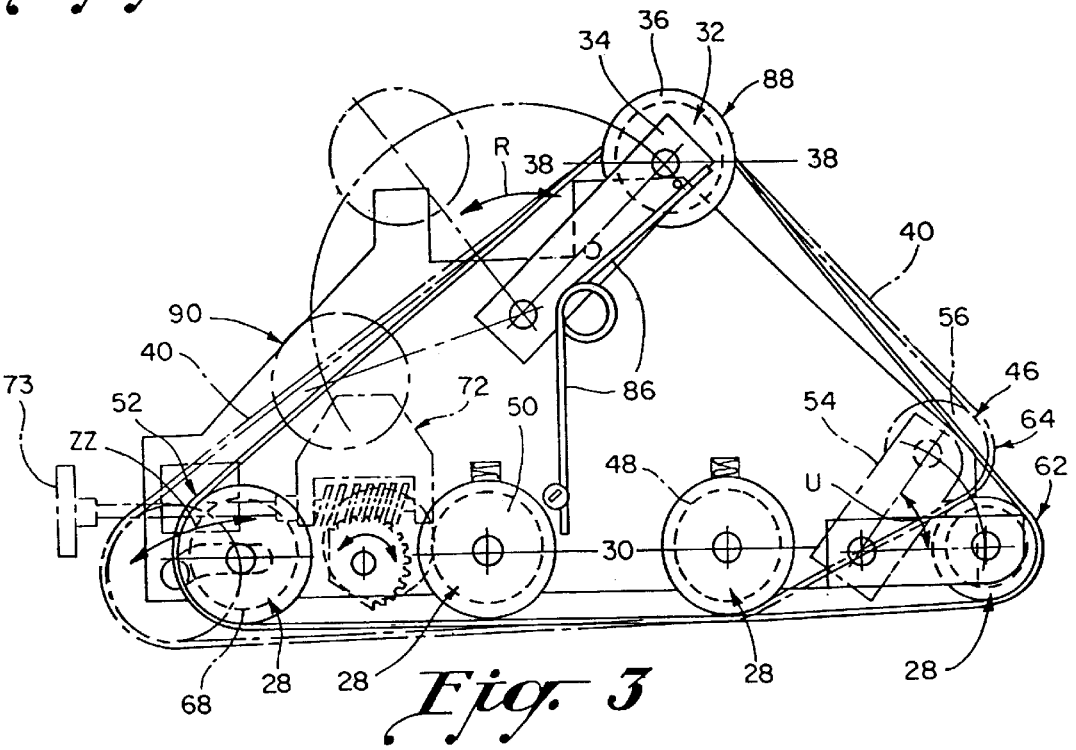
FIG. 3 is a side elevational section view of the first vehicle side of the inline delivery vehicle shown in FIG. 2, now showing the adjustment possiblities of a plurality of adjustable longitudinally spaced rollers and the pivotal capabilities of a belt tension roller assembly.

FIGS. 2–9 also show a plurality of adjustable longitudinally spaced rollers 28 that are rotatably connected to the first vehicle side 24 and the second vehicle side 26 and are positioned between the first vehicle side and the second vehicle side. The plurality of adjustable longitudinally spaced rollers each have an axis 30 parallel to one another and positioned parallel and proximate the plurality of driven rollers 16, as shown in FIGS. 3 and 9.

Figure 5:
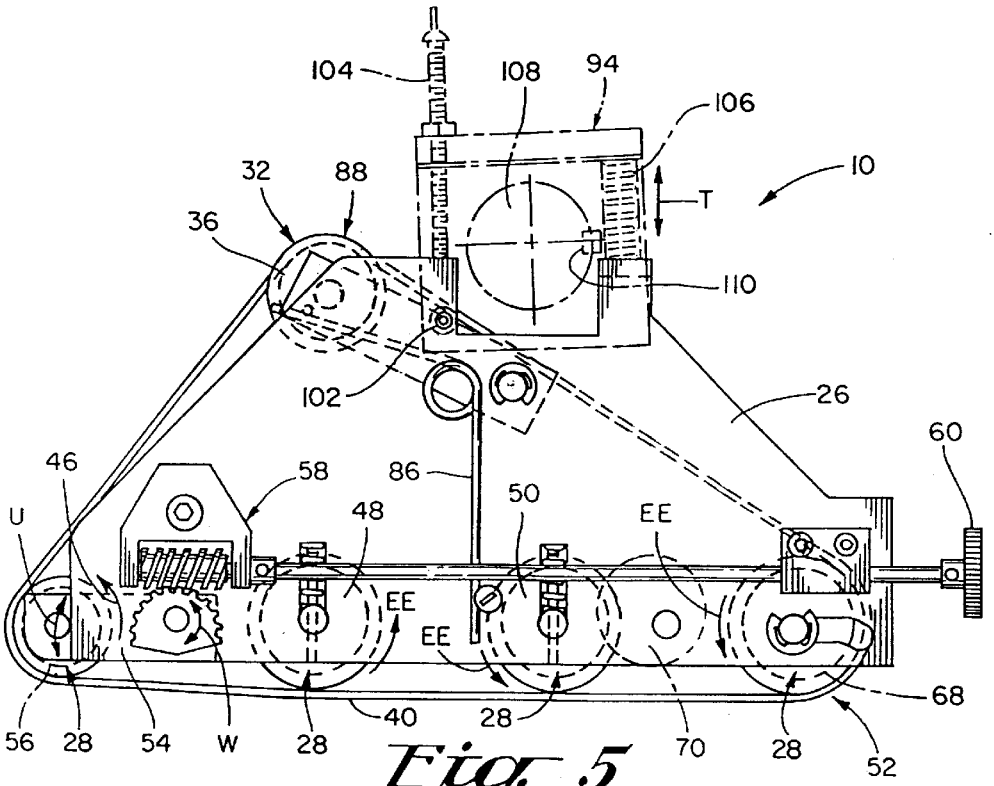
FIG. 5 is side elevational section view of a second side of the inline delivery vehicle showing the attachment of the inline delivery vehicle to the mounting bracket table attachment structure of FIG. 1 including the shock absorbent movement of a plurality of upper bracket springs and the adjustable tension of the belt.

In other embodiments, as shown in FIGS. 5, 8 and 14, the plurality of adjustable longitudinally spaced rollers 28 comprises a first roller assembly 46 that is located proximate the rotary trimmer 22, a second roller 48 that is located proximate the first roller assembly and distal the rotary trimmer, a third roller 50 that is located proximate the second roller and distal the first roller assembly and the conveyor belt 20, and a fourth roller assembly 52 that is located proximate the third roller and proximate the conveyor belt. Each roller is capable of rotation, as shown by double-arrows EE, about the axis 30, which in other embodiments is a shaft.

Figure 6:
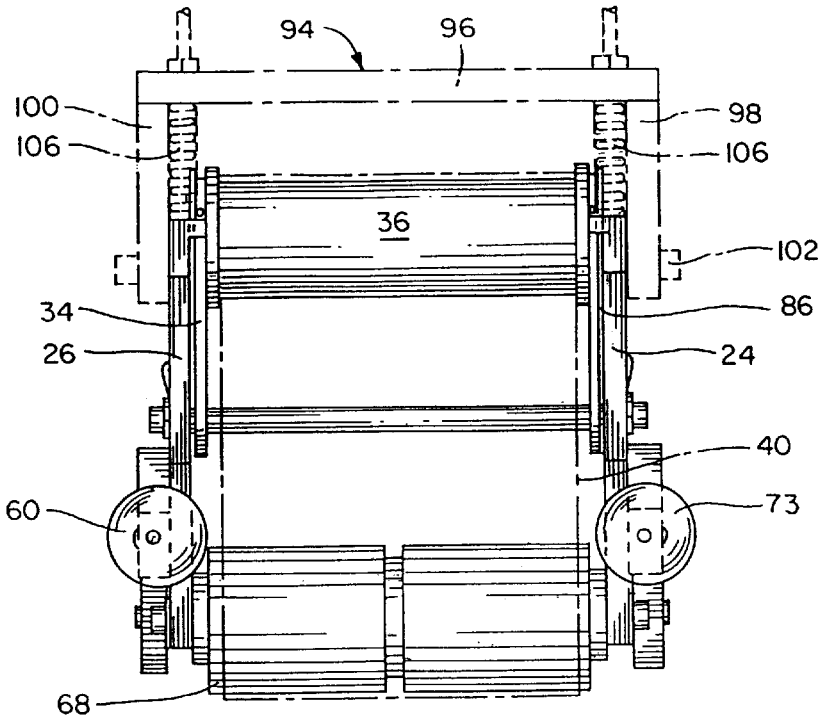
FIG. 6 is a rear elevational section view of the inline delivery vehicle showing a first handle, a second handle, a fourth roller, and a guidance roller.

The inline delivery vehicle 10 also comprises a belt tension roller assembly 32, as shown in FIGS. 2–7. The belt tension roller assembly comprises a plurality of tension arms 34 and a guidance roller 36 rotatably connected between the plurality of tension arms. The plurality of tension arms is pivotably connected to the first vehicle side 24 and the second vehicle side 26, as shown diagramatically by a double-arrow R in FIG. 3, and is positioned between the first vehicle side and the second vehicle side as is shown in FIGS. 2, 6 and 7. The guidance roller has a tension roller axis 38 that extends parallel and distal the axis 30 of each of the plurality of adjustable longitudinally spaced rollers 28, the belt tension roller assembly is also extended above the plurality of adjustable longitudinally spaced rollers as shown in FIGS. 2–7 to provide adjustable tension as the inline delivery vehicle 10 is used during the paper delivery process.

Figure 4:
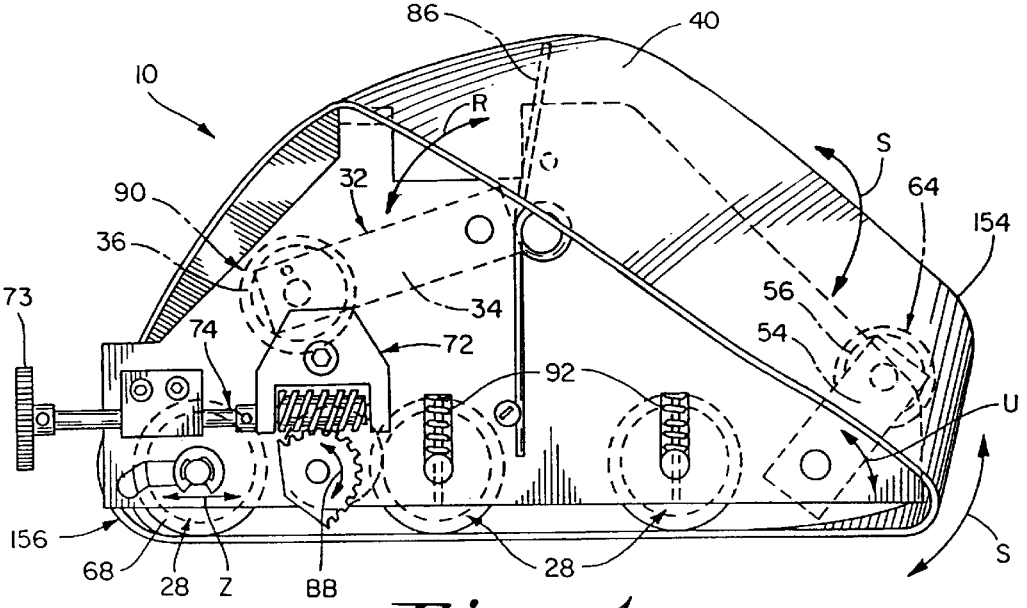
FIG. 4 is side elevational section view of the first vehicle side of FIG. 3, now showing a quick removal and replacement of a belt removably coupled to the plurality of adjustable longitudinally spaced rollers.

Finally, the inline delivery vehicle 10 comprises a belt 40, as shown in FIGS. 1, 2–7 (in phantom in some of the figures). A key feature of the inline delivery is that the belt is removably coupled to the plurality of adjustable longitudinally spaced rollers 28 and the guidance roller 36, not only for rotation of the belt and delivery of the paper 14 shown in FIGS. 1 and 9, but for quick, efficient removal and replacement of the belt, as shown in FIG. 4 and as described below.

As shown in FIG. 3, the belt tension roller assembly 32 and the plurality of adjustable longitudinally spaced rollers 28 provide adjustable tension to the belt as is shown by the double-arrow R, a double-arrow U, and a double-arrow Z wherein the various roller movements, as discussed below, are varied to adjust the tension to the belt. Furthermore, the belt is removably and uniformly driven, as shown by double-arrows XX, by the plurality of driven rollers 16, which rotate as shown by double-arrows YY, when the belt is placed on top of the plurality of driven rollers as shown in FIGS. 1 and 9.

The use of the belt 40 over the rollers 28 provides a means for continuous surface area for paper delivery and significantly decreases the possibility of jamming because, among other reasons known in the art, the belt eliminates gaps between the rollers. The use of the belt also minimizes the loss of settings and therefore increases the time of machine use and decreases the downtime of the delivery table.

The plurality of adjustable longitudinally spaced rollers 28 are properly adjusted so as to create a first nip 42, or leading nip, located upstream of the belt 40 and a second nip 44, or trailing nip, located downstream of the belt, as shown in FIG. 9. The adjustment capabilities to the first nip and the second nip are critical to the ability of the inline delivery vehicle 10 to substantially eliminate paper jamming. In summary, the inline delivery vehicle thereby speedily advances the paper 14 from the rotary trimmer 22 to the conveyor belt 20 and the paper enters at the first nip and exits at the second nip and thereby substantially eliminates jamming of the paper.

Now, the first roller assembly 46 shown in FIGS. 3–5, 7, 9 and 11 further comprises a plurality of pivotable first roller arms 54 and a first roller 56 rotatably connected to the plurality of pivotable first roller arms The plurality of pivotable first roller arms is pivotably attached, as shown by a double-arrow U, to the first vehicle side 24 and the second vehicle side 26. A first gear and cable assembly 58 is operatively attached to the second vehicle side and a first handle 60 is fixably attached to the first gear and cable assembly to provide easier adjustment without the need for farther tools.

Figure 11:
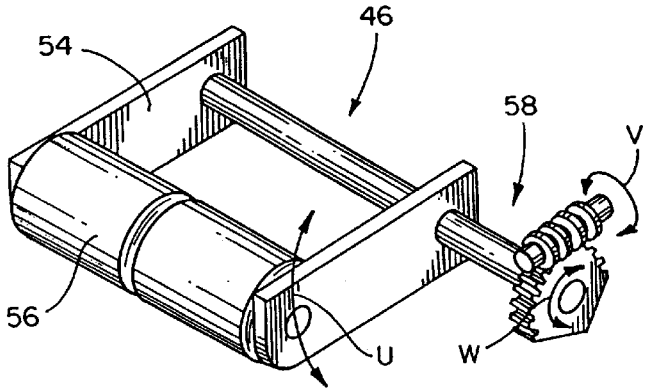
FIG. 11 is a perspective view from the second vehicle side showing a first gear and cable assembly for the adjustment of the first roller.

The first gear and cable assembly 58, or first gear assembly, is operatively connected to the first roller assembly 46, as shown in FIGS. 5 and 8, and in one embodiment, as shown in FIG. 11, rotates as shown by double-arrows V and W, in order to move the first roller assembly upward and downward, as shown by the double-arrow U. The first roller assembly is therefore movable upward and downward, as shown in FIGS. 3, 5, and 9, relative to the plurality of driven rollers 16 from a lower first roller state 62 to a raised first roller state 64 to adjust to a thickness 66 of the paper 14 and thereby substantially eliminates paper jamming at the first nip 42.

Figure 10:
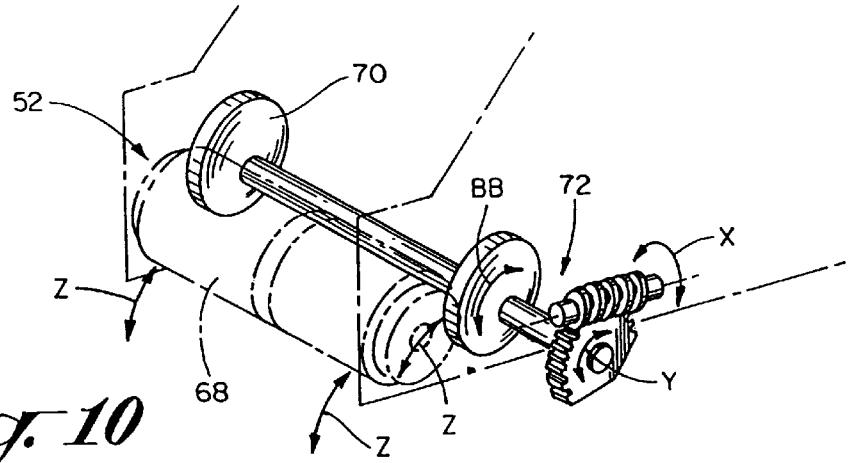
FIG. 10 is a schematic perspective view of the first vehicle side of the inline delivery vehicle showing a second gear and cable cam assembly for the adjustment of the fourth roller by cam-type movement.

The fourth roller assembly 52, as shown in FIGS. 2–4, 6–10, further comprises a fourth roller 68 and a control shaft 70 operatively connected to the fourth roller. The control shaft is configured to be increasingly eccentric in one direction of rotation as shown in FIG. 10 and a second gear and cable cam assembly 72 are operatively attached to the first vehicle side 24. A second handle 73 is fixably attached to the second gear and cable cam assembly to provide easier adjustment without the need for further tools, as shown in FIGS. 1, 2–4, 6–8.

The second gear and cable cam assembly 72, or second gear assembly, is operatively connected to the control shaft 70 and rotate the control shaft in a direction shown by double-arrows X, Y, and BB to move the fourth roller assembly 52 back and forth as shown by a double-arrow Z in FIG. 10 between a flush fourth roller position 74 and a pitched fourth roller position 76 relative to the first roller assembly 46, the second roller 48, and the third roller 50. The fourth roller 68 is operatively movable over an outer diameter 78 of a corresponding driven roller 80, as shown in FIG. 9, thereby pitching the belt 40 at an angle 82. The pitched fourth roller position controls the direction N of the paper and thereby kicks down and curls, or "swoops" the paper 14, as shown by the letter "B", at the second nip 44 and substantially eliminates the need of a kicker (not shown) at the conveyor belt 20 at least 90% of the time. This feature allows successive sheets of paper to stack upon one another, as shown in FIG. 14, and it provides control over the direction of the delivered paper.

The belt tension roller assembly 32 shown in FIGS. 2–7 further comprises a plurality of torsion springs 86, or tension means, that are operatively connected to the plurality of tension arms 34 to provide adjustable tension to the belt 40. The plurality of torsion springs are attached to the first vehicle side 24 and the second vehicle side 26 and are pivotable, as shown by the double-arrow R, between a tensioned roller state 88 and a relaxed roller state 90 relative to the first vehicle side 24 and the second vehicle side 26.

The second roller 48 and the third roller 50 each having a plurality of compression springs 92 or compression means to provide adjustable tension, as shown by double-arrows CC, to the belt 40 and adjustable pressure to the paper 14, as shown in FIGS. 9, 14 and 14*a*, as the paper passes between the belt and the plurality of driven rollers 16. In one embodiment, a pin 163 can be inserted vertically into the first vertical side 24 or the second vertical side 26 to retain and support the compression springs. In a second embodiment, shown in FIG. 14*a*, the pin 163 is replace with a bearing sleeve 165 which is then axially inserted directly into the shaft of the second roller or the third roller by use of a "snap-tight" fit without the need for screws and the like. The compression spring will then ride directly on the bearing sleeve. The bearing sleeve is preferred because it increases the life of the roller, protects the shaft of the roller, and reduces friction on the first vertical side and the second vertical side. The bearing sleeve is also easy and quick to replace and provides for lower overall maintenance costs. Also, the movement U of the first roller assembly 46 and the movement Z of the fourth roller assembly 52 provide adjustable tension to the belt 40 and adjustable pressure to the paper 14.

Now, in order to attach the inline delivery vehicle 10 to the first stage web offset printing press delivery table as shown in FIG. 1, the inline delivery vehicle further comprises a mounting bracket attachment structure 94, as shown in FIGS. 2, 5–7. The mounting bracket attachment structure attaches the first vehicle side 24 and the second vehicle side 26 to the upwardly adjustable bracket structure as shown in FIG. 1. The mounting bracket attachment structure comprises, as shown in FIG. 2, an upper plate 96, a first bracket side plate 98 that is perpendicularly attached to the upper plate, a second bracket side plate 100 that is perpendicularly attached to the upper plate and that is located parallel and opposite the first bracket side plate.

The mounting bracket attachment structure 94 also comprises connection means 102 shown in FIG. 2, for removably attaching the first bracket side plate 98 to the first vehicle side 24 and for attaching the second bracket side plate 100 to the second vehicle side 26. A vertical stabilizer means 104 passes through the upper plate 96 to vertically stabilize the mounting bracket attachment structure to the inline delivery vehicle 10 and a plurality of upper bracket springs 106 attached to the upper plate 96 to provide vibrational absorption, as shown by double arrows T in FIG. 5, to the inline delivery vehicle during paper delivery. The first bracket side plate and the second bracket side plate each have a mounting bar hole 108 and each mounting bar hole has a key slot 110.

A mounting bar 112 is connected to the upwardly adjustable bracket structure 18, as shown in FIG. 1 and the mounting bar has a key indentation 114. The mounting bar passes through each mounting bar hole 108 to support the inline delivery vehicle 10 over the plurality of driven rollers 16. A key bar 116 is insertable into the key slot 110 between the mounting bar hole 108 and the key indentation 114 of the mounting bar to provide rigid nonrotational support to the inline delivery vehicle. The upwardly adjustable bracket structure is operatively movable from the lowered bracket state 118 to the raised bracket state 120 relative to the plurality of driven rollers 16 as shown in FIG. 1*a*. The plurality of adjustable longitudinally spaced rollers 16 also provide vibrational absorption to the inline delivery vehicle during paper delivery as discussed above.

A key feature of my invention is shown in FIG. 4. The belt 40 is removably de-installed from or replaceably reinstalled on the inline delivery vehicle 10 in order to provide a quick, efficient change or repair of the belt. The belt is slideable, as shown by double-arrows S, over either the first vehicle side 24 or the second vehicle side 26.

To remove the belt 40 or to replace it, as shown in FIG. 4, the upwardly adjustable bracket structure 18 is moved to the raised bracket state 120 and the first vehicle side 24 is disconnected from the first bracket side plate 98 by removing the connection means 102 and the second vehicle side 26 is disconnected from the second bracket side plate 100 by removing the connection means 102. The first roller 56 is moved to the raised first roller state 64 to relax the tension on the belt 40, the fourth roller 68 is moved to the flush fourth roller position 74 to relax the tension on the belt and the plurality of tension arms 34 are pivoted to the relaxed roller state 90 to relax the tension on the belt. With the belt relaxed and not tensioned, the belt is then replaceably removable from the plurality of adjustable longitudinally spaced rollers 28 and the guidance roller 36.

This key feature of my invention means that the belt 40 is quickly removed from or replaced on the inline delivery vehicle 10 within a period of 30 seconds. This allows for very small downtime and for cost savings during the printing press delivery stage.

Figure 12:
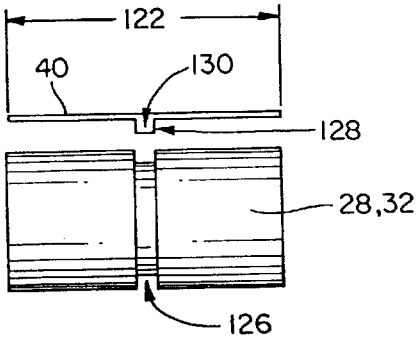
FIG. 12 is a cut away longitudinal view of a first type of roller and belt combination showing the use of a Vee Guide to guide the belt over the roller.
Figure 13:
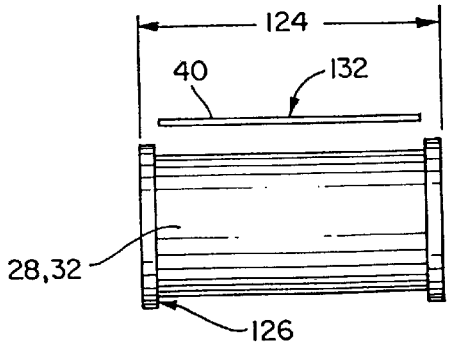
FIG. 13 is a cut away longitudinal view of a second type of roller and belt combination showing the use of a flanged roller to guide the belt over the roller.

Finally, as shown in FIGS. 12 and 13, the belt 40 has a belt width 122 and the plurality of adjustable longitudinally spaced rollers 28 and the belt tension roller assembly 32 each have a roller width 124 being sized to accommodate the belt width. The rollers can be made of materials, such as nylon, and can have an outer diameter of about 1 ½ inches, though the first roller 56 may have a smaller outer diameter than the other rollers. The rollers can have roller widths varying from three to seven inches wide, though these figures are not intended to limit the roller widths. Those skilled in the art will note that the width of the rollers and the belt will and can vary significantly due to the different types of printing jobs and different printing materials. My invention is designed to cover these different situations. As a general rule of thumb, the roller width will be about ¼ inch wider than the belt width.

As to the belt 40 and belt width 122, the belt usually has a common length of about 21 inches and the belt width will vary from 2 ½ to 7 inches wide, again depending on the printing job needs. The inline delivery vehicle 10 then has an overall length of about 10 inches, a height of about 5 inches, and a width of about 5 ½ inches, though the dimensions of the inline delivery vehicle are not to be limited to these particular dimensions. Belts typically have a thickness varying from 0.030 to 3/64 inch and no adjustments are needed on the inline delivery vehicle to accommodate these different belt thickness.

FIGS. 12 and 13 also shows that the plurality of adjustable longitudinally spaced rollers 28 and the guidance roller 36 each have a belt tracking capability 126 and that the belt 40 has a tracking type 128 to guide the belt over each roller and to increase belt life. The belt provides a constant surface area of travel to improve paper delivery and to decrease uneven wear and tear on the plurality of adjustable longitudinally spaced rollers and the guidance roller. The belt used on my invention can be constructed of different materials depending on a customer's needs and the tracking type can vary from what is known in the art as a "Vee-Guide" 130 as is shown in FIG. 12 to a flat endless style 132 as is shown in FIG. 13. The Vee-Guide provides positive tracking of the belt and longer belt-life. As is shown in FIGS. 2, 6–8, 10–13 my invention can be built to accommodate either tracking type without changing belt tracking capability, though FIG. 12 shows a vee-guided belt tracking capability and FIG. 13 shows a flat/flanged belt tracking capability. Installation time will remain the same for any style used.

As to materials used, the various connections can be made using the standard connectors in the art, such as screws, bolts, clips, C clips, and the like. The components of the mounting bracket attachment structure 94 can be welded, screwed, and so forth. The first vertical side 24 and the second vertical side 26 are preferably constructed of steel, though other materials can be used. The plurality of driven rollers 16 can be constructed of nylon, rubber, or the like and the belt can be constructed of 2-ply or 3-ply canvas having an outer rubber coating, though other belt constructions can be used. The first gear and cable assembly 58 and the second gear and cable cam assembly 72 can use various gears, such as worm gears and the like, and it is contemplated that cables, rods, and the like can also be used. The torsion spring 86 can be constructed of heavy wire gauge, such as that having a rating of 9 ft-lb/inch, and the like. The compression springs 92 can have a rating of 20 lb/inch and so forth.

Furthermore, first roller assembly 46 can be clipped to the first vehicle side 24 and the second vehicle side 26 and the plurality of first roller arms 54 can be attached to the axis or shaft 30, with the shaft being connected to the first vehicle side and the second vehicle side. The mounting bracket attachment structure 94 can be connected to the inline delivery vehicle 10 using bolt and clip or "speed nuts" and the like. Finally, the vertical stabilizer means 104 can be a common threaded bolt or the like.

An additional advantage of my invention is that at least one inline delivery vehicle 10 can be used to deliver paper on the first stage web offset printing press delivery table 12. This means that more than one inline delivery vehicle, shown in phantom in FIG. 1, can be placed or positioned side-by-side the inline delivery vehicle 10 and then timed together, with this other inline delivery vehicle 201 on the mounting bar 112 as well, similar to that which is shown in FIG. 1, in order to increase product flow and diversification. Hence, in FIG. 1 the inline delivery vehicles would be placed on the mounting bar 112 together and more than one product line could then be ran at the same time.

In operation, as shown in FIGS. 1, 1*a*, 9, and 14 one will understand a method of using my invention, the inline delivery vehicle 10, for delivering paper 14 from a first point 132 to a second point 134 using the inline delivery vehicle which is operatively connected with the first stage web offset printing press delivery table 12, the paper having the thickness 66, a length 136, a leading edge 138, and a trailing edge 140 opposite the leading edge.

The method of using the inline delivery vehicle 10, as shown in FIGS. 9 and 14, comprises the steps of: (a) adjusting, the double-arrow U, the leading nip 42, or first nip, and the belt 40 of the inline delivery vehicle 10 to thereby substantially conform to the thickness 66 of each paper to substantially eliminate paper jamming; (b) adjusting, shown by double-arrow Z, the trailing nip 44, or second nip, and the belt of the inline delivery vehicle depending on the length 136 of each sheet of paper; (c) feeding, shown by arrow N, the leading edge 138 of a first sheet of paper 150 through the rotary trimmer 22, that is in between the knife cylinder 23 and the anvil cylinder 25, at the first point 132 and towards the adjusted leading nip 42.

The next steps are (d) passing the leading edge 138 of the first fed sheet of paper 150 through the adjusted leading nip 42 and into a pathway 142 between the adjusted belt 40 and driving means 16; (e) cutting the trailing edge 140 of the first fed sheet of paper while located in the pathway; (f) accelerating the passage of the cut first fed sheet of paper 150 away from the adjusted leading nip and the rotary trimmer 22 so that the trailing edge 140 of the cut first fed sheet of paper 150 passes the adjusted leading nip 42 and into the pathway 142; (g) feeding, arrow N, the leading edge 138 of a second sheet of paper 152 through the rotary trimmer 22 at the first point 132 and towards the adjusted leading nip 42; (h) pressing down, as shown by double-arrow CC, on the cut first fed sheet of paper 150 while passing through the pathway 142 to provide continuous accelerated nonslip delivery; (i) passing, arrow N, the leading edge of the second fed sheet of paper through the adjusted leading nip 42 and into the pathway between the adjusted belt 40 and driving means 16.

The key to the success of the inline delivery vehicle 10 is found in the next set of steps: A) creating a gap 152 between the trailing edge 140 of the cut first fed sheet of paper 150 and the leading edge 138 of the second first fed sheet of paper 152 in the pathway 142 to prevent paper jamming; (k) cutting, arrows Q and Q', the trailing edge of the second fed sheet of paper while located in the pathway; (1) passing the leading edge 138 of the accelerated cut first fed sheet of paper 150 through the adjusted trailing nip 44 towards the second point 134 at the conveyor belt 20 while controlling a direction, arrow DD, of the accelerated cut first fed sheet of paper 150 at the adjusted trailing nip 44; (m) accelerating the passage of the cut second fed sheet of paper 152 away from the adjusted leading nip 42 and the rotary trimmer 22 so that the trailing edge 140 of the cut second fed sheet of paper passes the adjusted leading nip 42 and into the pathway 142; (n) pressing down, double-arrow CC, on the cut second fed sheet of paper while passing through the pathway to provide continuous accelerated nonslip delivery; (o) passing, arrow N, the trailing edge 140 of the accelerated cut first fed sheet of paper 150 through the adjusted trailing nip 44 and towards the second point 134 at the conveyor belt 20 while controlling the direction, arrow DD, of the accelerated cut first fed sheet of paper at the adjusted trailing nip; (p) passing, arrow N, the leading edge 138 of the accelerated cut second fed sheet of paper 152 through the adjusted trailing nip 44 towards the second point 134 at the conveyor belt while controlling the direction, arrow DD, of the accelerated cut second fed sheet of paper at the adjusted trailing nip; and (q) passing, arrow N, the trailing edge 140 of the accelerated cut second fed sheet 152 of paper through the adjusted trailing nip 44 and towards the second point 134 at the conveyor belt while controlling the direction, arrow DD, of the accelerated cut second fed sheet of paper at the adjusted trailing nip.

A further step in the method is shown in FIGS. 9 and 14 wherein the step of adjusting the first nip 42 and the belt 40 includes: moving a leading portion 154 of the belt upward or downward; creating an angulated moved leading portion of the adjusted belt 40; allowing passage sufficient below the angulated moved leading portion 154 to accommodate the thickness 66 of each sheet of paper; and retaining each sheet of paper parallel and proximate to the pathway between the adjusted belt 40 and the driving means 16 to prevent paper jamming thereby defining the first nip 42 by the upward or downward movement.

Another step in the method, also shown in FIGS. 9 and 14 describes the step of adjusting the second nip 44 and the belt 40. This step includes moving a trailing portion 156 of the belt backward or forward, double-arrow Z; angling, double-arrow ZZ, the moved trailing portion 156 of the belt 40 in pitched fashion or flush fashion, double-arrow ZZ; creating the angle 82: a pitched angle or a flush angle at the angled moved trailing portion of the belt 152 for paper delivery control; and controlling, arrow DD, the direction of passage of each sheet of paper at the second point 134; and defining the second nip 44 by the created angle 82.

Further steps in the method, as shown in FIG. 14, are the steps of passing both the trailing edge 140 of the accelerated cut first fed sheet of paper 150 and the trailing edge 140 of the accelerated cut second fed sheet of paper 152 through the adjusted trailing nip 44 includes: directing, arrow DD, the trailing edge of each accelerated cut fed sheet of paper 150 at the angle 82; and kicking down and curling, arrow DD, the trailing edge 140 of each accelerated cut fed sheet of paper as the trailing edge leaves the adjusted trailing nip 44 to stack the sheets of paper, as shown by "B" wherein a trailing edge 140 of a paper labeled 205 is covered by the leading edge 138 of the paper 150, as shown in FIG. 14.

The method further comprises the key steps, shown in FIGS. 1–4 of: raising, double-arrow O, the upwardly adjustable bracket structure 118 connecting the inline delivery vehicle 10; detaching, double-arrow FF, the inline delivery vehicle from the raised upwardly adjustable bracket structure; adjusting, double-arrow U, the leading portion 154 of the belt 40, of the detached inline delivery vehicle, upward; adjusting, double-arrow Z, the trailing portion 156 of the belt 40, of the detached inline delivery vehicle 10, forward to the flush fashion or flush position 74; pivoting, double-arrow R, a belt tension roller assembly 32, of the detached inline delivery vehicle 10, downward; relaxing the tension on the belt 40; and removing, double-arrow S, the relaxed belt 40 from the inline delivery vehicle 10 thereby de-installing the belt from the detached inline delivery vehicle 10.

To perform the operation of installing or reinstalling the belt on the inline delivery vehicle 10, also shown in FIGS. 1 4, and 9, the following steps are performed. These steps comprise: installing, double-arrow S, the relaxed belt 40 on the detached inline delivery vehicle; pivoting, double-arrow R, the belt tension roller assembly 32 upward to apply tension to the relaxed belt; adjusting, double-arrow U, the leading portion 154 of the belt, of the detached inline delivery vehicle, downward; adjusting, double-arrow Z, the trailing portion 156 of the belt 40, of the detached inline delivery vehicle, backward to the pitched fashion; increasing the tension on the belt; attaching, double-arrow FF, the detached inline delivery vehicle 10 to the raised upwardly adjustable bracket structure 118; and lowering, double-arrow O, the upwardly adjustable bracket structure thereby replacing, reinstalling, or installing the belt on the inline delivery vehicle.

Finally, the method further comprises the steps shown in FIGS. 5 and 9. These steps further comprise: the step of absorbing vibrations, double-arrow T, of the inline delivery vehicle 10 during paper delivery to substantially reduce wear and to substantially improve performance of the inline delivery vehicle.

As various possible embodiments may be made in the above invention for use for different purposes and as various changes might be made in the embodiments and methods above set forth, it is understood that all of the above matters here set forth or shown in the accompanying drawings are to be interpreted as illustrative and not in a limiting sense.

I claim:

1. In combination, an inline delivery vehicle for substantially improving performance of and for substantially eliminating paper jamming on a first stage printing press delivery table, the first stage printing press delivery table having a plurality of driven rollers for increasing the advancing speed of a paper and an upwardly adjustable bracket structure extending above the plurality of driven rollers, the inline delivery vehicle comprising:

a first vehicle side being positioned perpendicular and proximate the plurality of driven rollers;

a second vehicle side being positioned perpendicular and proximate the plurality of driven rollers and adjacent the first vehicle side, the first vehicle side and the second vehicle side being removably connected to the upwardly adjustable bracket structure;

a plurality of adjustable longitudinally spaced rollers being rotatably connected to and positioned between the first vehicle side and the second vehicle side, the plurality of adjustable longitudinally spaced rollers each having an axis parallel to one another and being positioned parallel and proximate the plurality of driven rollers, the plurality of adjustable longitudinally spaced rollers comprising a first roller assembly being located proximate a rotary trimmer of the first stage printing press delivery table, a second roller being located proximate the first roller assembly and distal the rotary trimmer, a third roller being located proximate the second roller and distal the first roller assembly and a conveyor belt of the first stage printing press delivery table, and a fourth roller assembly being located proximate the third roller and proximate the conveyor belt, the first roller assembly further including: a plurality of pivotable first roller arms and a first roller rotatably connected to the plurality of pivotable first roller arms, the plurality of pivotable first roller arms being pivotably attached to the first vehicle side and the second vehicle side, a first gear assembly being operatively attached to the second vehicle side and operatively connected to the first roller assembly for moving the first roller assembly upward and downward, the first roller assembly movable upward and downward relative to the plurality of driven rollers from a lower first roller state to a raised first roller state for adjusting to a thickness of the paper at a first nip proximate the rotary trimmer;

a belt tension roller assembly being pivotably connected to and positioned between the first vehicle side and the second vehicle side, the belt tension roller assembly having a tension roller axis being extended parallel and distal the axis of each of the plurality of adjustable longitudinally spaced rollers; and a belt being removably coupled to the plurality of adjustable longitudinally spaced rollers and the belt tension roller assembly for rotation of the belt and delivery of the paper, the belt tension roller assembly and the plurality of adjustable longitudinally spaced rollers for adjusting tension of the belt, the plurality of driven rollers for removably and uniformly driving the belt for speedily advancing the paper.

2. In combination, an inline delivery vehicle for substantially improving performance of and for substantially eliminating paper jamming on a first stage printing press delivery table, the first stage printing press delivery table having a plurality of driven rollers for increasing the advancing speed of a paper and an upwardly adjustable bracket structure extending above the plurality of driven rollers, the inline delivery vehicle comprising:

a first vehicle side being positioned perpendicular and proximate the plurality of driven rollers;

a second vehicle side being positioned perpendicular and proximate the plurality of driven rollers and adjacent the first vehicle side, the first vehicle side and the second vehicle side being removably connected to the upwardly adjustable bracket structure;

a plurality of adjustable longitudinally spaced rollers being rotatably connected to and positioned between the first vehicle side and the second vehicle side, the plurality of adjustable longitudinally spaced rollers each having an axis parallel to one another and being positioned parallel and proximate the plurality of driven rollers, the plurality of adjustable longitudinally spaced rollers comprising a first roller assembly being located proximate a rotary trimmer of the first stage printing press delivery table, a second roller being located proximate the first roller assembly and distal the rotary trimmer, a third roller being located proximate the second roller and distal the first roller assembly and a conveyor belt of the first stage printing press delivery table, and a fourth roller assembly being located proximate the third roller and proximate the conveyor belt, the fourth roller assembly further including: a fourth roller and a control shaft operatively connected to the fourth roller, the control shaft configured to be increasingly eccentric in one direction of rotation, a second gear assembly being operatively attached to the first vehicle side and operatively connected to the control shaft for rotating the control shaft and for moving the fourth roller assembly back and forth between a flush fourth roller position and a pitched fourth roller position relative to the first roller assembly, the second roller, and the third roller, the pitched fourth roller position for controlling a direction of the paper for kicking down and curling the paper at a second nip proximate the conveyor belt and for substantially eliminating the need of a kicker at the conveyor belt;

a belt tension roller assembly being pivotably connected to and positioned between the first vehicle side and the second vehicle side, the belt tension roller assembly having a tension roller axis being extended parallel and distal the axis of each of the plurality of adjustable longitudinally spaced rollers; and a belt being removably coupled to the plurality of adjustable longitudinally spaced rollers and the belt tension roller assembly for rotation of the belt and delivery of the paper, the belt tension roller assembly and the plurality of adjustable longitudinally spaced rollers for adjusting tension of the belt, the plurality of driven rollers for removably and uniformly driving the belt for speedily advancing the paper, the fourth roller operatively movable over an outer diameter of a corresponding driven roller for pitching the belt at an angle.

3. In combination, an inline delivery vehicle for substantially improving performance of and for substantially eliminating paper jamming on a first stage printing press delivery table, the first stage printing press delivery table having a plurality of driven rollers for increasing the advancing speed of a paper and an upwardly adjustable bracket structure extending above the plurality of driven rollers, the inline delivery vehicle comprising:

a first vehicle side being positioned perpendicular and proximate the plurality of driven rollers;

a second vehicle side being positioned perpendicular and proximate the plurality of driven rollers and adjacent the first vehicle side, the first vehicle side and the second vehicle side being removably connected to the upwardly adjustable bracket structure;

a plurality of adjustable longitudinally spaced rollers being rotatably connected to and positioned between the first vehicle side and the second vehicle side, the plurality of adjustable longitudinally spaced rollers each having an axis parallel to one another and being positioned parallel and proximate the plurality of driven rollers, the plurality of adjustable longitudinally spaced rollers comprising a first roller assembly being located proximate a rotary trimmer of the first stage printing press delivery table, a second roller being located proximate the first roller assembly and distal the rotary trimmer, a third roller being located proximate the second roller and distal the first roller assembly and a conveyor belt of the first stage printing press delivery table, and a fourth roller assembly being located proximate the third roller and proximate the conveyor belt;

a belt tension roller assembly being pivotably connected to and positioned between the first vehicle side and the second vehicle side, the belt tension roller assembly having a tension roller axis being extended parallel and distal the axis of each of the plurality of adjustable longitudinally spaced rollers; and a belt being removably coupled to the plurality of adjustable longitudinally spaced rollers and the belt tension roller assembly for rotation of the belt and delivery of the paper, the belt tension roller assembly and the plurality of adjustable longitudinally spaced rollers for adjusting tension of the belt, the plurality of driven rollers for removably and uniformly driving the belt for speedily advancing the paper, the belt tension roller assembly further including: a plurality of tension arms being pivotably connected to the first vehicle side and the second vehicle side and being positioned between the first vehicle side and the second vehicle side, tension means operatively connected to the plurality of tension arms for adjusting the tension of the belt, the tension means attached to the first vehicle side and the second vehicle side, the plurality of tension arms pivotable between a tensioned roller state and a relaxed roller state relative to the first vehicle side and the second vehicle side, the second roller and the third roller each having compression means arms for adjusting the tension of the belt and for adjusting pressure to the paper as the paper passes between the belt and the plurality of driven rollers, the movement of the first roller assembly and the movement of the fourth roller assembly for adjusting the tension of the belt and for adjusting the pressure to the paper.

4. In combination, an inline delivery vehicle for substantially improving performance of and for substantially eliminating paper jamming on a first stage printing press delivery table, the first stage printing press delivery table having a plurality of driven rollers for increasing the advancing speed of a paper and an upwardly adjustable bracket structure extending above the plurality of driven rollers, the inline delivery vehicle comprising:

a first vehicle side being positioned perpendicular and proximate the plurality of driven rollers;

a second vehicle side being positioned perpendicular and proximate the plurality of driven rollers and adjacent the first vehicle side, the first vehicle side and the second vehicle side being removably connected to the upwardly adjustable bracket structure;

a plurality of adjustable longitudinally spaced rollers being rotatably connected to and positioned between the first vehicle side and the second vehicle side, the plurality of adjustable longitudinally spaced rollers each having an axis parallel to one another and being positioned parallel and proximate the plurality of driven rollers, the plurality of adjustable longitudinally spaced rollers comprising a first roller assembly being located proximate a rotary trimmer of the first stage printing press delivery table, a second roller being located proximate the first roller assembly and distal the rotary trimmer, a third roller being located proximate the second roller and distal the first roller assembly and a conveyor belt of the first stage printing press delivery table, and a fourth roller assembly being located proximate the third roller and proximate the conveyor belt;

a belt tension roller assembly being pivotably connected to and positioned between the first vehicle side and the second vehicle side, the belt tension roller assembly having a tension roller axis being extended parallel and distal the axis of each of the plurality of adjustable longitudinally spaced rollers;

a belt being removably coupled to the plurality of adjustable longitudinally spaced rollers and the belt tension roller assembly for rotation of the belt and delivery of the paper, the belt tension roller assembly and the plurality of adjustable longitudinally spaced rollers for adjusting tension of the belt, the plurality of driven rollers for removably and uniformly driving the belt for speedily advancing the paper; and a mounting bracket attachment structure for attaching the first vehicle side and the second vehicle side to the upwardly adjustable bracket structure, connection means for removably attaching the mounting bracket attachment structure to the first vehicle side and the second vehicle side, the mounting bracket attachment structure having a plurality of upper bracket springs operatively connected to the first vehicle side and the second vehicle side for providing vibrational absorption to the inline delivery vehicle during paper delivery, the upwardly adjustable bracket structure providing rigid nonrotational support to the inline delivery vehicle over the plurality of driven rollers, the upwardly adjustable bracket structure operatively movable from a lowered bracket state to a raised bracket state relative to the plurality of driven rollers, the plurality of adjustable longitudinally spaced rollers for providing vibrational absorption to the inline delivery vehicle during paper delivery.

5. The combination of claim 4, wherein the belt is removably de-installed from or replaceably reinstalled on the inline delivery vehicle, the belt being slideable over either the first vehicle side or the second vehicle side, the upwardly adjustable bracket structure being moved to the raised bracket state, the first vehicle side and the second vehicle side being disconnected from the mounting bracket attachment structure by removing the connection means, the first roller assembly being moved to a raised first roller state for relaxing the tension on the belt, the fourth roller assembly being moved to a flush fourth roller position for relaxing the tension on the belt, the belt tension roller assembly being pivoted to a relaxed roller state for relaxing the tension on the belt, the belt being replaceably removed from the plurality of adjustable longitudinally spaced rollers and the belt tension roller assembly.

6. In combination, an inline delivery vehicle for substantially improving performance of and for substantially eliminating paper jamming on a first stage printing press delivery table, the first stage printing press delivery table having a plurality of driven rollers for increasing the advancing speed of a paper and an upwardly adjustable bracket structure extending above the plurality of driven rollers, the inline delivery vehicle comprising:

a first vehicle side being positioned perpendicular and proximate the plurality of driven rollers;

a second vehicle side being positioned perpendicular and proximate the plurality of driven rollers and adjacent the first vehicle side, the first vehicle side and the second vehicle side being removably connected to the upwardly adjustable bracket structure;

a plurality of adjustable longitudinally spaced rollers being rotatably connected to and positioned between the first vehicle side and the second vehicle side, the plurality of adjustable longitudinally spaced rollers each having an axis parallel to one another and being positioned parallel and proximate the plurality of driven rollers, the plurality of adjustable longitudinally spaced rollers comprising a first roller assembly being located proximate a rotary trimmer of the first stage printing press delivery table, a second roller being located proximate the first roller assembly and distal the rotary trimmer, a third roller being located proximate the second roller and distal the first roller assembly and a conveyor belt of the first stage printing press delivery table, and a fourth roller assembly being located proximate the third roller and proximate the conveyor belt;

a belt tension roller assembly being pivotably connected to and positioned between the first vehicle side and the second vehicle side, the belt tension roller assembly having a tension roller axis being extended parallel and distal the axis of each of the plurality of adjustable longitudinally spaced rollers;

a belt being removably coupled to the plurality of adjustable longitudinally spaced rollers and the belt tension roller assembly for rotation of the belt and delivery of the paper, the belt tension roller assembly and the plurality of adjustable longitudinally spaced rollers for adjusting tension of the belt, the plurality of driven rollers for removably and uniformly driving the belt for speedily advancing the paper; and a mounting bracket attachment structure for attaching the first vehicle side and the second vehicle side to the upwardly adjustable bracket structure, the mounting bracket attachment structure comprising: an upper plate, a first bracket side plate being perpendicularly attached to the upper plate, a second bracket side plate being perpendicularly attached to the upper plate and being located parallel and opposite the first bracket side plate, connection means for removably attaching the first bracket side plate to the first vehicle side and for attaching the second bracket side plate to the second vehicle side, a vertical stabilizer means passing through the upper plate for vertically stabilizing the mounting bracket attachment structure to the inline delivery vehicle, and a plurality of upper bracket springs attached to the upper plate for providing vibrational absorption to the inline delivery vehicle during paper delivery, the first bracket side plate and the second bracket side plate each having a mounting bar hole, each mounting bar hole having a key slot, a mounting bar connected to the upwardly adjustable bracket structure, the mounting bar having a key indentation, the mounting bar passing through each mounting bar hole to support the inline delivery vehicle over the plurality of driven rollers, a key bar insertable into the key slot between the mounting bar hole and the key indentation of the mounting bar for providing rigid nonrotational support to the inline delivery vehicle, the upwardly adjustable bracket structure operatively movable from a lowered bracket state to a raised bracket state relative to the plurality of driven rollers, the plurality of adjustable longitudinally spaced rollers for providing vibrational absorption to the inline delivery vehicle during paper delivery.

7. The combination of claim 6, wherein the belt is removably de-installed or replaceably reinstalled on the inline delivery vehicle, the belt being slideable over either the first vehicle side or the second vehicle side, the upwardly adjustable bracket structure being moved to the raised bracket state, the first vehicle side being disconnected from the first bracket side plate by removing the connection means and the second vehicle side being disconnected from the second bracket side plate by removing the connection means, the first roller assembly being moved to a raised first roller state for relaxing the tension on the belt, the fourth roller assembly being moved to a flush fourth roller position for relaxing the tension on the belt, the belt tension roller assembly being pivoted to a relaxed roller state for relaxing the tension on the belt, the belt being replaceably removable from the plurality of adjustable longitudinally spaced rollers and the belt tension roller assembly.

8. The combination of claim 2, further comprising a bearing sleeve removably axially inserted into either the first vehicle side or the second vehicle side, the bearing sleeve axially inserted into either the axis of the second roller or the third roller, compression means riding directly on the bearing sleeve.

9. An inline delivery vehicle for substantially improving performance of a first stage web offset printing press delivery table, for substantially eliminating paper jamming and for substantially increasing safety of operations, the inline delivery vehicle comprising:

a first vehicle side being perpendicular and proximately positionable to a plurality of driven rollers of the first stage web offset printing press delivery table;

a second vehicle side being perpendicular and proximately positionable to the plurality of driven rollers and being adjacent the first vehicle side, the first vehicle side and the second vehicle side being removably connectable to an upwardly adjustable bracket structure of the first stage web offset printing press delivery table;

a plurality of adjustable longitudinally spaced rollers being rotatably connected to the first vehicle side and the second vehicle side and being positioned between the first vehicle side and the second vehicle side, the plurality of adjustable longitudinally spaced rollers each having an axis parallel to one another and being parallel and proximately positionable to the plurality of driven rollers, the plurality of adjustable longitudinally spaced rollers comprising a first roller assembly being proximately positionable to a rotary trimmer of the first stage web offset printing press delivery table, a second roller being located proximate the first roller assembly and being distally positionable to the rotary trimmer, a third roller being located proximate the second roller and distal the first roller assembly, the third roller being distally positionable to a conveyor belt of the first stage web offset printing press delivery table, and a fourth roller assembly being located proximate the third roller and being proximately positionable to the conveyor belt;

a belt tension roller assembly being pivotably connected to the first vehicle side and the second vehicle side and being positioned between the first vehicle side and the second vehicle side, the belt tension roller assembly having a tension roller axis being extended parallel and distal the axis of each of the plurality of adjustable longitudinally spaced rollers, the belt tension roller assembly being extended above the plurality of adjustable longitudinally spaced rollers; and a belt being removably coupled to the plurality of adjustable longitudinally spaced rollers and the belt tension roller assembly for rotation of the belt and delivery of the paper, the belt tension roller assembly and the plurality of adjustable longitudinally spaced rollers for adjusting tension of the belt, the plurality of driven rollers for removably and uniformly driving the belt for speedily advancing the paper, the first roller assembly further including: a plurality of pivotable first roller arms and a first roller rotatably connected to the plurality of pivotable first roller arms, the plurality of pivotable first roller arms being pivotably attached to the first vehicle side and the second vehicle side, a first gear and cable assembly being operatively attached to the second vehicle side and operatively connected to the first roller assembly to move the first roller assembly upward and downward, a first handle being fixably attached to the first gear and cable assembly, the first roller assembly movable upward and downward relative to the plurality of driven rollers from a lower first roller state to a raised first roller state for adjusting to a thickness of the paper at a first nip proximate the rotary trimmer.

10. An inline delivery vehicle for substantially improving performance of a first stage web offset printing press delivery table, for substantially eliminating paper jamming and for substantially increasing safety of operations, the inline delivery vehicle comprising:

a first vehicle side being perpendicular and proximately positionable to a plurality of driven rollers of the first stage web offset printing press delivery table;

a second vehicle side being perpendicular and proximately positionable to the plurality of driven rollers and being adjacent the first vehicle side, the first vehicle side and the second vehicle side being removably connectable to an upwardly adjustable bracket structure of the first stage web offset printing press delivery table;

a plurality of adjustable longitudinally spaced rollers being rotatable connected to the first vehicle side and the second vehicle side and being positioned between the first vehicle side and the second vehicle side, the plurality of adjustable longitudinally spaced rollers each having an axis parallel to one another and being parallel and proximately positionable to the plurality of driven rollers, the plurality of adjustable longitudinally spaced rollers comprising a first roller assembly being proximately positionable to a rotary trimmer of the first stage web offset printing press delivery table, a second roller being located proximate the first roller assembly and being distally positionable to the rotary trimmer, a third roller being located proximate the second roller and distal the first roller assembly, the third roller being distally positionable to a conveyor belt of the first stage web offset printing press delivery table, and a fourth roller assembly being located proximate the third roller and being proximately positionable to the conveyor belt;

a belt tension roller assembly being pivotably connected to the first vehicle side and the second vehicle side and being positioned between the first vehicle side and the second vehicle side, the belt tension roller assembly having a tension roller axis being extended parallel and distal the axis of each of the plurality of adjustable longitudinally spaced rollers, the belt tension roller assembly being extended above the plurality of adjustable longitudinally spaced rollers; and a belt being removably coupled to the plurality of adjustable longitudinally spaced rollers and the belt tension roller assembly for rotation of the belt and delivery of the paper, the belt tension roller assembly and the plurality of adjustable longitudinally spaced rollers for adjusting tension of the belt, the plurality of driven rollers for removably and uniformly driving the belt for speedily advancing the paper, the fourth roller assembly further including: a fourth roller and a control shaft operatively connected to the fourth roller, the control shaft configured to be increasingly eccentric in one direction of rotation, a second gear and cable cam assembly being operatively attached to the first vehicle side and a second handle being fixably attached to the second gear and cable cam assembly, the second gear and cable cam assembly operatively connected to the control shaft for rotating the control shaft and for moving the fourth roller assembly back and forth between a flush fourth roller position and a pitched fourth roller position relative to the first roller assembly, the second roller, and the third roller, the fourth roller operatively movable over an outer diameter of a corresponding driven roller for pitching the belt at an angle, the pitched fourth roller position for controlling a direction of the paper for kicking down and curling the paper at a second nip proximately positionable to the conveyor belt and for substantially eliminating the need of a kicker positionable at the conveyor belt.

11. An inline delivery vehicle for substantially improving performance of a first stage web offset printing press delivery table, for substantially eliminating paper jamming and for substantially increasing safety of operations, the inline delivery vehicle comprising:

a first vehicle side being perpendicular and proximately positionable to a plurality of driven rollers of the first stage web offset printing press delivery table;

a second vehicle side being perpendicular and proximately positionable to the plurality of driven rollers and being adjacent the first vehicle side, the first vehicle side and the second vehicle side being removably connectable to an upwardly adjustable bracket structure of the first stage web offset printing press delivery table;

a plurality of adjustable longitudinally spaced rollers being rotatably connected to the first vehicle side and the second vehicle side and being positioned between the first vehicle side and the second vehicle side, the plurality of adjustable longitudinally spaced rollers each having an axis parallel to one another and being parallel and proximately positionable to the plurality of driven rollers, the plurality of adjustable longitudinally spaced rollers comprising a first roller assembly being proximately positionable to a rotary trimmer of the first stage web offset printing press delivery table, a second roller being located proximate the first roller assembly and being distally positionable to the rotary trimmer, a third roller being located proximate the second roller and distal the first roller assembly, the third roller being distally positionable to a conveyor belt of the first stage web offset printing press delivery table, and a fourth roller assembly being located proximate the third roller and being proximately positionable to the conveyor belt;

a belt tension roller assembly being pivotably connected to the first vehicle side and the second vehicle side and being positioned between the first vehicle side and the second vehicle side, the belt tension roller assembly having a tension roller axis being extended parallel and distal the axis of each of the plurality of adjustable longitudinally spaced rollers, the belt tension roller assembly being extended above the plurality of adjustable longitudinally spaced rollers; and a belt being removably coupled to the plurality of adjustable longitudinally spaced rollers and the belt tension roller assembly for rotation of the belt and delivery of the paper, the belt tension roller assembly and the plurality of adjustable longitudinally spaced rollers for adjusting tension of the belt, the plurality of driven rollers for removably and uniformly driving the belt for speedily advancing the paper, the belt tension roller assembly further including: a plurality of tension arms and a guidance roller rotatably connected between the plurality of tension arms, the plurality of tension arms being pivotably connected to the first vehicle side and the second vehicle side and being positioned between the first vehicle side and the second vehicle side, tension means operatively connected to the plurality of tension arms for adjusting the tension of the belt, the tension means attached to the first vehicle side and the second vehicle side, the plurality of tension arms pivotable between a tensioned roller state and a relaxed roller state relative to the first vehicle side and the second vehicle side, the second roller and the third roller each having a plurality of compression springs for adjusting the tension of the belt and for adjusting pressure to the paper as the paper passes between the belt and the plurality of driven rollers, the movement of the first roller assembly and the movement of the fourth roller assembly for adjusting the tension of the belt and for adjusting the pressure to the paper.

12. An inline delivery vehicle for substantially improving performance of a first stage web offset printing press delivery table, for substantially eliminating paper jamming and for substantially increasing safety of operations, the inline delivery vehicle comprising:

a first vehicle side being perpendicular and proximately positionable to a plurality of driven rollers of the first stage web offset printing press delivery table;

a second vehicle side being perpendicular and proximately positionable to the plurality of driven rollers and being adjacent the first vehicle side, the first vehicle side and the second vehicle side being removably connectable to an upwardly adjustable bracket structure of the first stage web offset printing press delivery table;

a plurality of adjustable longitudinally spaced rollers being rotatably connected to the first vehicle side and the second vehicle side and being positioned between the first vehicle side and the second vehicle side, the plurality of adjustable longitudinally spaced rollers each having an axis parallel to one another and being parallel and proximately positionable to the plurality of driven rollers, the plurality of adjustable longitudinally spaced rollers comprising a first roller assembly being proximately positionable to a rotary trimmer of the first stage web offset printing press delivery table, a second roller being located proximate the first roller assembly and being distally positionable to the rotary trimmer, a third roller being located proximate the second roller and distal the first roller assembly, the third roller being distally positionable to a conveyor belt of the first stage web offset printing press delivery table, and a fourth roller assembly being located proximate the third roller and being proximately positionable to the conveyor belt;

a belt tension roller assembly being pivotably connected to the first vehicle side and the second vehicle side and being positioned between the first vehicle side and the second vehicle side, the belt tension roller assembly having a tension roller axis being extended parallel and distal the axis of each of the plurality of adjustable longitudinally spaced rollers, the belt tension roller assembly being extended above the plurality of adjustable longitudinally spaced rollers;

a belt being removably coupled to the plurality of adjustable longitudinally spaced rollers and the belt tension roller assembly for rotation of the belt and delivery of the paper, the belt tension roller assembly and the plurality of adjustable longitudinally spaced rollers for adjusting tension of the belt, the plurality of driven rollers for removably and uniformly driving the belt for speedily advancing the paper; and a mounting bracket attachment structure removably connectable to the upwardly adjustable bracket structure for providing rigid nonrotational support to the inline delivery vehicle when proximately positionable to the plurality of driven rollers, the mounting bracket attachment structure removably attached to the first vehicle side and the second vehicle side, connection means for removably attaching the mounting bracket attachment structure to the first vehicle side and the second vehicle side, the mounting bracket attachment structure having a plurality of upper bracket springs operatively connected to the first vehicle side and the second vehicle side for providing vibrational absorption to the inline delivery vehicle during paper delivery, the mounting bracket attachment structure operatively movable with the upwardly adjustable bracket structure from a lowered bracket state to a raised bracket state relative to the plurality of driven rollers, the plurality of adjustable longitudinally spaced rollers for providing vibrational absorption to the inline delivery vehicle during paper delivery.

13. The inline delivery vehicle of claim 12, wherein the belt is removably de-installed from or replaceably reinstalled on the inline delivery vehicle, the belt being slideable over either the first vehicle side or the second vehicle side, the mounting bracket attachment structure being positionable with the upwardly adjustable bracket structure in the raised bracket state, the first vehicle side and the second vehicle side being disconnected from the mounting bracket attachment structure by removing the connection means, the first roller assembly being moved to a raised first roller state for relaxing the tension on the belt, the fourth roller assembly being moved to a flush fourth roller position for relaxing the tension on the belt, the belt tension roller assembly being pivoted to a relaxed roller state for relaxing the tension on the belt, the belt being replaceably removed from the plurality of adjustable longitudinally spaced rollers and the belt tension roller assembly.

14. An inline delivery vehicle for substantially improving performance of a first stage web offset printing press delivery table, for substantially eliminating paper jammning and for substantially increasing safety of operations, the inline delivery vehicle comprising:

a first vehicle side being perpendicular and proximately positionable to a plurality of driven rollers of the first stage web offset printing press delivery table;

a second vehicle side being perpendicular and proximately positionable to the plurality of driven rollers and being adjacent the first vehicle side, the first vehicle side and the second vehicle side being removably connectable to an upwardly adjustable bracket structure of the first stage web offset printing press delivery table;

a plurality of adjustable longitudinally spaced rollers being rotatably connected to the first vehicle side and the second vehicle side and being positioned between the first vehicle side and the second vehicle side, the plurality of adjustable longitudinally spaced rollers each having an axis parallel to one another and being parallel and proximately positionable to the plurality of driven rollers, the plurality of adjustable longitudinally spaced rollers comprising a first roller assembly being proximately positionable to a rotary trimmer of the first stage web offset printing press delivery table, a second roller being located proximate the first roller assembly and being distally positionable to the rotary trimmer, a third roller being located proximate the second roller and distal the first roller assembly, the third roller being distally positionable to a conveyor belt of the first stage web offset printing press delivery table, and a fourth roller assembly being located proximate the third roller and being proximately positionable to the conveyor belt;

a belt tension roller assembly being pivotably connected to the first vehicle side and the second vehicle side and being positioned between the first vehicle side and the second vehicle side, the belt tension roller assembly having a tension roller axis being extended parallel and distal the axis of each of the plurality of adjustable longitudinally spaced rollers, the belt tension roller assembly being extended above the plurality of adjustable longitudinally spaced rollers;

a belt being removably coupled to the plurality of adjustable longitudinally spaced rollers and the belt tension roller assembly for rotation of the belt and delivery of the paper, the belt tension roller assembly and the plurality of adjustable longitudinally spaced rollers for adjusting tension of the belt, the plurality of driven rollers for removably and uniformly driving the belt for speedily advancing the paper; and a mounting bracket attachment structure removably connectable to the upwardly adjustable bracket structure for providing rigid nonrotational support to the inline delivery vehicle when proximately positionable to the plurality of driven rollers, the mounting bracket attachment structure removably attachable to the first vehicle side and the second vehicle side, the mounting bracket attachment structure comprising: an upper plate, a first bracket side plate being perpendicularly attached to the upper plate, a second bracket side plate being perpendicularly attached to the upper plate and being located parallel and opposite the first bracket side plate, connection means for removably attaching the first bracket side plate to the first vehicle side and for attaching the second bracket side plate to the second vehicle side, a vertical stabilizer means passing through the upper plate for vertically stabilizing the mounting bracket attachment structure to the inline delivery vehicle, and a plurality of upper bracket springs attached to the upper plate for providing vibrational absorption to the inline delivery vehicle during paper delivery, the first bracket side plate and the second bracket side plate each having a mounting bar hole, each mounting bar hole having a key slot, the first bracket side plate and the second bracket side plate operatively connectable to a mounting bar connected to the upwardly adjustable bracket structure, the inline delivery vehicle being rigidly nonrotationally supportable by the passage of the mounting bar and a key bar through each mounting bar hole and corresponding key slot, the mounting bracket attachment structure operatively movable with the upwardly adjustable bracket structure from a lowered bracket state to a raised bracket state relative to the plurality of driven rollers, the plurality of adjustable longitudinally spaced rollers for providing vibrational absorption to the inline delivery vehicle during paper delivery.

15. The inline delivery vehicle of claim 14, wherein the belt is removably de-installed or replaceably reinstalled on the inline delivery vehicle, the belt being slideable over either the first vehicle side or the second vehicle side, the mounting bracket attachment structure being positionable with the upwardly adjustable bracket structure in the raised bracket state, the first vehicle side being disconnected from the first bracket side plate by removing the connection means and the second vehicle side being disconnected from the second bracket side plate by removing the connection means, the first roller assembly being moved to a raised first roller state for relaxing the tension on the belt, the fourth roller assembly being moved to a flush fourth roller position for relaxing the tension on the belt, the belt tension roller assembly being pivoted to a relaxed roller state for relaxing the tension on the belt, the belt being replaceably removable from the plurality of adjustable longitudinally spaced rollers and the belt tension roller assembly.

16. The inline delivery vehicle of claim 15, further comprising a bearing sleeve removably axially inserted into either the first vehicle side or the second vehicle side, the bearing sleeve axially inserted into either the axis of the second roller or the third roller, each of a plurality of compression springs riding directly on the bearing sleeve.

17. An inline delivery vehicle for substantially improving performance of a first stage web offset printing press delivery table, for substantially eliminating paper jamming and for substantially increasing safety of operations, the inline delivery vehicle comprising:

a first vehicle side being perpendicular and proximately positionable to a plurality of driven rollers of the first stage web offset printing press delivery table;

a second vehicle side being perpendicular and proximately positionable to the plurality of driven rollers and being adjacent the first vehicle side, the first vehicle side and the second vehicle side being removably connectable to an upwardly adjustable bracket structure of the first stage web offset printing press delivery table;

a plurality of adjustable longitudinally spaced rollers being rotatably connected to and positioned between the first vehicle side and the second vehicle side, the plurality of adjustable longitudinally spaced rollers being adjustable in upstream and downstream directions, the plurality of adjustable longitudinally spaced rollers each having an axis parallel to one another and being parallel and proximately positionable to the plurality of driven rollers, the plurality of adjustable longitudinally spaced rollers comprising a first roller assembly being located proximate a rotary trimmer of the first stage printing press delivery table, a second roller being located proximate the first roller assembly and distal the rotary trimmer, a third roller being located proximate the second roller and distal the first roller assembly and a conveyor belt of the first state printing press delivery table, and a fourth roller assembly being located proximate the third roller and proximate the conveyor belt;

a belt tension roller assembly being pivotably connected to the first vehicle side and the second vehicle side and being positioned between the first vehicle side and the second vehicle side and extended above the plurality of adjustable longitudinally spaced rollers, the belt tension roller assembly having a tension roller axis extending parallel, distal, and above the axis of each of the plurality of adjustable longitudinally spaced rollers, the belt tension roller assembly being extended above the plurality of adjustable longitudinally spaced rollers; and a belt being removably attached to the plurality of adjustable longitudinally spaced rollers and the belt tension roller assembly for rotation of the belt about the axis of each of the plurality of adjustable longitudinally spaced rollers and the tension roller axis, the belt tension roller assembly and the plurality of adjustable longitudinally spaced rollers for adjusting tension of the belt, the plurality of driven rollers for removably and uniformly driving the belt; the belt tension roller assembly further including a plurality of tension arms pivotable between a tensioned roller state and a relaxed roller state relative to the first vehicle side and the second vehicle side, tension means attached to the first vehicle side and the second vehicle side and operatively connected to the plurality of tension arms for adjusting the tension of the belt, the second roller and third roller each having compression means arm for adjusting the tension of the belt and for adjusting pressure to the paper as the paper passes between the belt and the plurality of driven rollers, the movement of the first roller assembly and the movement of the fourth roller assembly for adjusting the tension of the belt and for adjusting the pressure to the paper.

18. The inline delivery vehicle of claim 17, wherein at least one inline delivery vehicle is used to deliver paper on the first stage web offset printing press delivery table and at least two inline delivery vehicles are positioned in side-by-side fashion.

19. The inline delivery vehicle of claim 17, wherein the belt has a belt width and the plurality of adjustable longitudinally spaced rollers and the belt tension roller assembly each have a roller width being sized to accommodate the belt width, the plurality of adjustable longitudinally spaced rollers and the belt tension roller assembly each having a belt tracking capability and the belt having a tracking type for guiding the belt over each roller, the belt providing a constant surface area of travel.

* * * * *